US007866810B2

(12) United States Patent
Campion et al.

(10) Patent No.: US 7,866,810 B2
(45) Date of Patent: Jan. 11, 2011

(54) INK JET PRINTER

(75) Inventors: Kevin Campion, Minnetonka, MN (US); Aaron Barclay, Prior Lake, MN (US); Chad Beery, Mound, MN (US); Christian Vasbo, White Bear Lake, MN (US); Corrine Ruether, Bloomington, MN (US); Joe Kubes, Rosemount, MN (US); Rick Bigaouette, Chaska, MN (US); Randy Johnston, Lakeville, MN (US); Pete Ladas, Eden Prairie, MN (US); Pete Schmidt, Chanhassen, MN (US); John Knaack, Burnsville, MN (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1007 days.

(21) Appl. No.: 11/704,509

(22) Filed: Feb. 9, 2007

(65) Prior Publication Data

US 2008/0192075 A1 Aug. 14, 2008

(51) Int. Cl.
*B41J 2/01* (2006.01)

(52) U.S. Cl. ..... 347/104; 347/106

(58) Field of Classification Search ..... None
See application file for complete search history.

(56) References Cited

U.S. PATENT DOCUMENTS 4,339,763 A 7/1982 Kyser et al.
4,544,931 A 10/1985 Watanabe et al.
6,068,374 A * 5/2000 Kurata et al. ..... 347/108
6,145,979 A 11/2000 Caiger et al.
6,454,405 B1 9/2002 Stowe
6,457,806 B2 10/2002 Hickman
6,543,890 B1 4/2003 Ylitalo et al.
6,554,414 B2 4/2003 Ylitalo et al.
6,789,876 B2 9/2004 Barclay et al.
6,848,765 B1 2/2005 Cleveland
6,866,359 B2 3/2005 Pan et al.
6,957,887 B2 10/2005 Bruhn
7,052,106 B1 5/2006 Onuma et al.
7,121,661 B2 10/2006 Watanabe
7,140,711 B2 11/2006 Nerad et al.
2003/0011670 A1 1/2003 Shirakawa

* cited by examiner

*Primary Examiner*—Stephen D Meier
*Assistant Examiner*—Alexander C Witkowski

(57) ABSTRACT

An improved large-format inkjet printer that is capable of providing more efficient and higher quality printing on a variety of print media, including for example, paper, fabric, corrugated media, and plywood. The improved printer provides improvements to the platen assembly, rail assembly, service station assembly, printhead assembly and vacuum assembly to provide improved printing capability. In addition the printer provides a table assembly that can be integrated into the platen assembly to provide a secure and flush surface for supporting various types of print media.

15 Claims, 28 Drawing Sheets

INK JET PRINTER

FIELD OF THE INVENTION

The present invention is directed to an improved ink jet printing apparatus. The present invention relates to various features of large format color inkjet printers.

BACKGROUND OF THE INVENTION

Inkjet printing has increased in popularity in recent years due to its relatively high speed and excellent image resolution. Moreover, an inkjet printing apparatus used in conjunction with a computer provides great flexibility in design and layout of the final image. The increased popularity of inkjet printing and the efficiencies in use have made inkjet printing an affordable alternative to previously known methods of printing.

In general, there are three types of inkjet printers in widespread use: the flat bed printer, the roll-to-roll printer and the drum printer. In the flat bed or large-format printer, the medium or substrate to receive the printed image rests on a horizontally extending flat table or bed. An inkjet print head is mounted on a movable carriage or other type of mechanism that enables the print head to be moved along two mutually perpendicular paths across the bed. The print head is connected to a computer that is programmed to energize certain nozzles of the print head as the print head traverses across the substrate, optionally using inks of different colors. The ink on the substrate is then cured as needed to provide the desired final image.

Large-format inkjet printers generally move a scanning carriage containing one or more print-heads in a transverse or horizontal direction across a print medium, while incrementally advancing—or "stepping"—a print medium in a lengthwise or vertical direction in-between successive printing passes, or scans, of a reciprocating carriage. Inkjet printing involves placing large quantities of tiny ink droplets formed by one or more ink-emitting (or "jetting") nozzles onto predetermined locations on a print medium or substrate. The ink droplets solidify or dry on the print medium forming small dots of color. A quantity of these small colored dots when viewed at a nominal distance will be perceived as a continuous-tone visual image. To increase the rate of print production, a print-head typically employs numerous jetting nozzles per color of ink ganged together in a suitable arrangement to create a band or "swath" of printed area that is much wider than otherwise would be obtainable from a single jetting nozzle. Usually, several linear arrays of jetting nozzles are disposed in a print-head in an orientation parallel to the direction of media travel (X-axis) and perpendicular to the direction of carriage travel (Y-axis). Both text and graphic images may be printed with inkjet printing.

Large scale digital color ink jet printers are described, for example in U.S. Pat. No. 6,789,876 to Barclay et al., the subject matter of which is herein incorporated by reference in its entirety.

In large format inkjet printers, the printhead is typically operable to simultaneously print ink of different colors. Preferably, the print head has at least four sets of nozzles that are in communication with at least four corresponding ink sources. As a result, the printhead is operable to simultaneously print at least four inks of different colors so that a wide color spectrum in the final printed image can be achieved.

Inks that are commonly used in inkjet printers include water-based inks, solvent-based inks and radiation-curable inks. Water-based inks are used with porous substrate or with substrates that have a special receptor coating that is capable of absorbing water. Typically, water-based inks do not perform well when used for printing on non-coated, non-porous films.

Solvent-based inks used in inkjet printers are suitable for printing on non-porous films and are able to overcome the problems associated with water-based ink formulations. However, these solvent-based inks contain a large volume (typically at least 90%) of organic solvent by weight. As the solvent-based ink dries, the solvent evaporates and may present an environmental hazard. In addition, inkjet printers using either solvent-based or water-based inks must remove relatively large quantities of solvent or water before the printing process is complete and the ink is dry such that the resulting printed product can be handled.

As a result of the problems with water-based and solvent-based inks, radiation-curable inks are herein proposed to be used for printing on a variety of non-coated, non-porous substrates. The use of radiation curing enables the ink to dry quickly without the need to drive off large quantities of water or solvent. As a result, radiation-curable inks can be used in the high speed ink jet printers proposed herein.

While large scale inkjet printers are well known, various improvements in these printers are necessary in order to provide more efficient and higher quality printing on a variety of print media, including for example, paper, fabric, corrugated media, plywood etc.

SUMMARY OF THE INVENTION

It is an object of the present invention to provide an inkjet printer apparatus having an improved vacuum platen assembly for temporarily securing the print media as it travels through a print zone.

It is another object of the present invention to provide an inkjet printer apparatus having a table assembly that is integrated into the platen assembly of the printer.

It is another object of the present invention to provide a service station assembly having an adjustable height so that it is capable of cleaning inkjet printheads during the printing process with printing media of various thicknesses.

It is another object of the present invention to provide a service station assembly having an improved cleaning capability for removing ink and debris from inkjet printheads.

It is still another object of the present invention to provide a rail assembly having an improved means of adjusting to the thickness of the print media.

It is still another object of the present invention to provide an improved pinch roller assembly having an interchangeable pinch roller and having a locking means for locking the pinch roller in place so that it does not contact the print media.

It is yet another object of the present invention to provide an improved curing assembly for curing UV curable inkjet inks as the ink is jetted onto the print media.

It is still another object of the present invention to provide an improved vacuum assembly for controlling the level of vacuum above the ink in the inkjet printheads.

It is still another object of the present invention to an improved method of minimizing print media waste in an inkjet printer assembly using a multi-pass print mode.

To that end, in one embodiment, the present invention relates to an ink jet printer apparatus comprising:

a platen assembly for supporting a print media within a print zone, wherein the platen assembly is capable of holding the print media in place during printing;

a media drive for guiding the print media across the platen and through the print zone, wherein the media drive is coupled to and cooperates with the platen assembly;

a rail assembly spaced apart from the platen assembly, said rail assembly supporting a scanning carriage assembly that is capable of traversing the width of the print media, said scanning carriage supporting at least one ink jet applicator assembly proximate to the print media; and a table assembly coupled to the platen assembly for supporting the print media as it is guided through the printer apparatus.

BRIEF DESCRIPTION OF THE DRAWINGS

The above set forth and other features of the invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DETAILED DESCRIPTION OF THE PREFERRED EMBODIMENTS

The present invention is directed to various improvements related to large scale inkjet printers, including large scale inkjet printers that utilize UV-curable inks.

Figure 1:
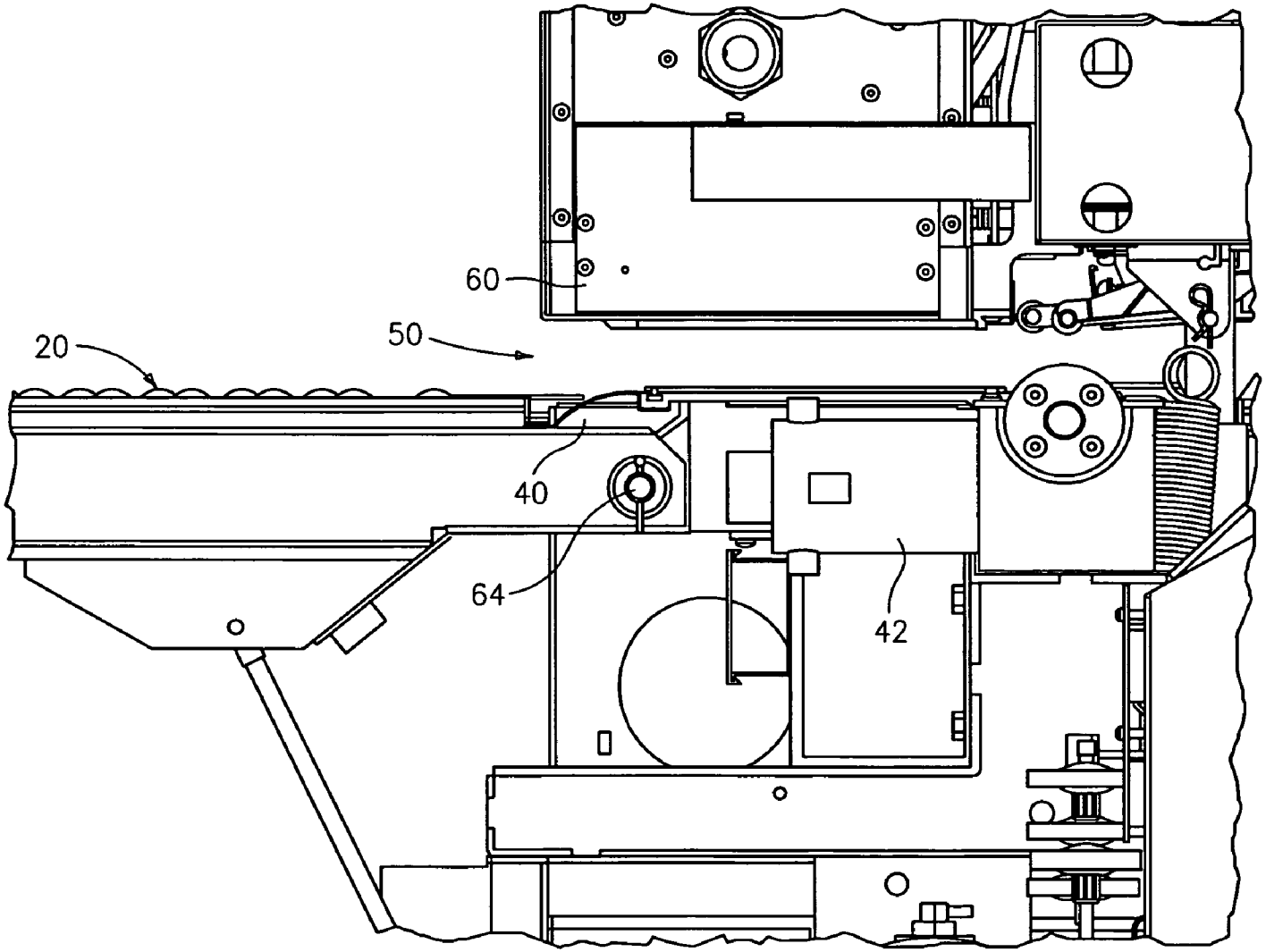
FIG. 1 depicts a partial side view of an ink jet printer in accordance with the present invention.

FIG. 1 depicts a view of an inkjet printer apparatus 10 in accordance with the present invention. As seen in FIG. 1, the ink jet printer apparatus 10 comprises a platen assembly 40 for supporting a print media (not shown) within a print zone 50. The platen assembly supports, or holds the print media in place during printing, typically by means of vacuum suction. The printer assembly also includes a media drive 42 for guiding the print media across the upper surface of the platen assembly 40 and through the print zone 50, and as such, the media drive 42 is coupled to and cooperates with the platen assembly 40 as discussed in more detail below.

The ink jet printer apparatus 10 also includes a rail assembly 100 spaced apart from the platen assembly 40 that supports a scanning carriage assembly 60 that is capable of traversing the width of the print media. The scanning carriage 60 supports at least one inkjet applicator assembly 61 proximate to the print media on the platen 40.

The inkjet printer apparatus 10 also includes a table assembly 20 that is coupled to the platen assembly 40 for supporting the print media as it is guided through the printer apparatus 10.

The platen assembly 40 is preferably used provide a vacuum holddown for applying a vacuum force to a print media to adhere the print media to the platen surface or to stabilize the print media relative to the surface to hold the print media temporarily to the platen in order to improve the quality of the print job. In one embodiment, the upper platen comprises extruded aluminum and horizontal surfaces of the upper platen remain unmachined. In another embodiment of the present invention, the upper platen is electrically grounded.

Figure 2:
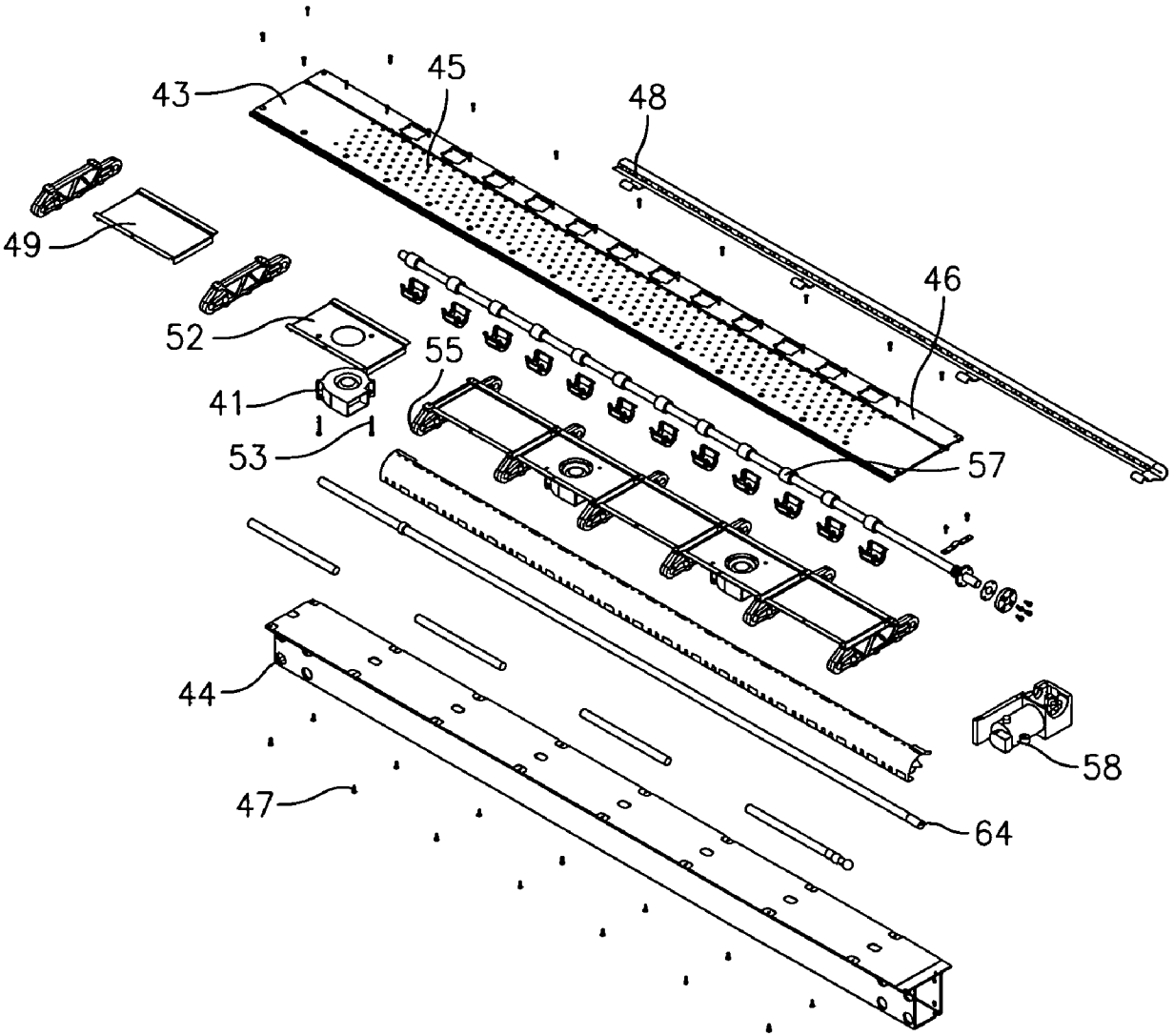
FIG. 2 depicts an exploded view of a platen assembly in accordance with the present invention.
Figure 3:
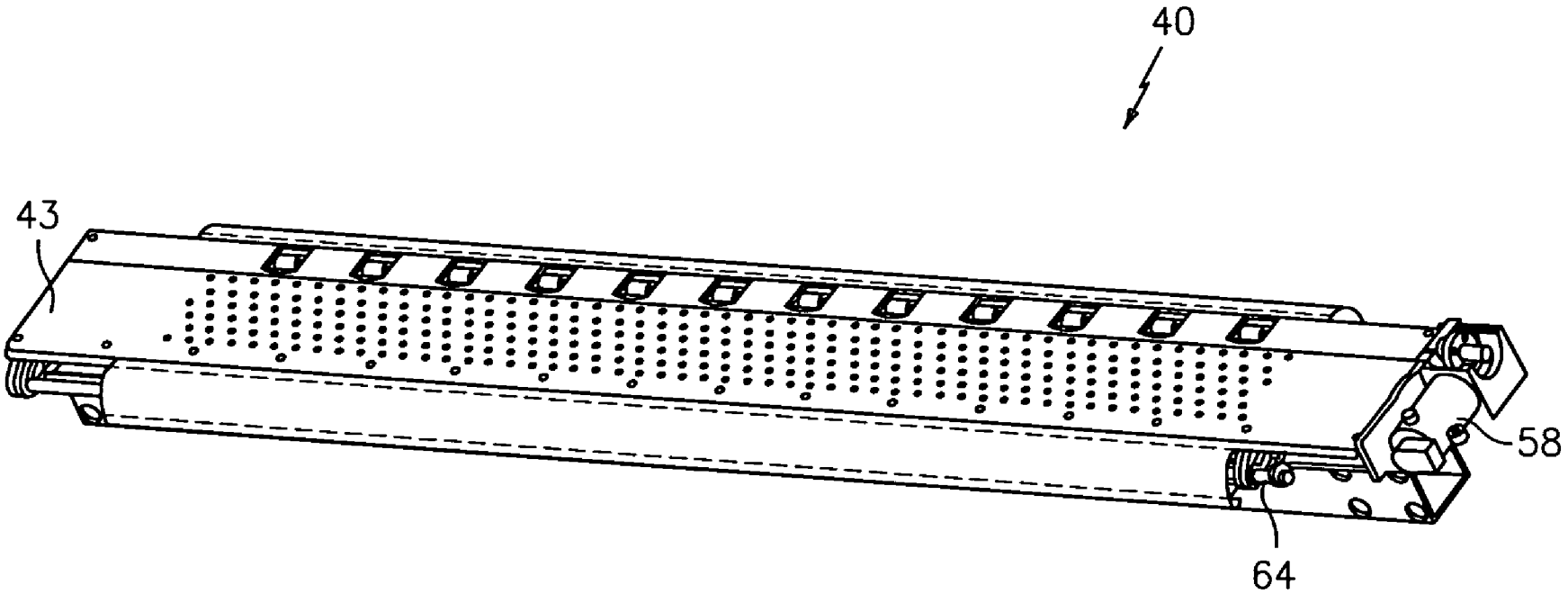
FIG. 3 depicts a different view of the platen assembly in accordance with the present invention.

FIGS. 2 and 3 depict different views of the platen assembly 40 of the invention. As seen in the exploded view of FIG. 2, the platen assembly 40 has an upper portion 43 and a lower portion 44 and a plurality of vacuum sources 41 arranged between the upper portion 43 and the lower portion 44 of the platen assembly 40. The upper portion 43 comprises a plurality of holes 45 through which the vacuum sources 41 cooperate to apply a suction force to the print media (not shown) positionable on the upper portion 43 of the platen assembly 40. Suitable fastening means 46 and 47, i.e., screws, are used for securing the upper portion 43 and lower portion 44 of the platen assembly 40.

The platen assembly 40 is mounted adjacent to at least one inkjet printhead assembly 61 which is supported by and movable on reciprocating scanning carriage 60 for reciprocating movement past the print media along an axis transverse to the media feed axis. The at least one inkjet printhead assembly 61 is supported by the scanning carriage 60 above the print media (not shown) and is discussed in more detail below.

Platen assembly 40 comprises an upper portion 43 that extends laterally across the printer along the X axis and is positioned below the plurality of inkjet assemblies. The upper portion 43 is positioned relative to the inkjet print head assembly 60 such that it supports the print media as the media is advanced past the inkjet print head assembly 60.

A platen extension output cover is 48 secured to the upper portion 43 of the platen assembly 40 to assist in advancing the print media out of the platen assembly 40. The upper portion 43 thus defines a support for the media in the print zone 50. The outer, opposite ends of upper portion 43, are mounted to and supported by the printer chassis (not shown). The upper portion 43 faces the scanning carriage 60 and provides a surface that defines a portion of print zone 50.

The plurality of vacuum sources 41 may take the form of a vacuum fan, or a similar blower, pump or the like. In a preferred embodiment, the plurality of vacuum sources 41 are blowers. A vacuum tray 49 having a plurality of fan mounts 52 is attached to the plurality of blowers 41. A series of platen mounts 55 are used to secure the plurality of blowers 41 to the upper portion 43 of the platen assembly. The plurality of blowers 41 are attached to the plurality of fan mounts 52 using suitable fastening means 53.

Media drive 42 advances the print media (not shown) through the print zone 50. Media drive 42 comprises a grit roller 57 which advances the print media (not shown) through the print zone 50. The grit roller 57 is advanced by media drive motor 58.

The platen assembly 40 also comprises a roller table shaft 64 which provides a pivot point for securing table assembly 20 to the platen assembly 20 as best seen in FIG. 1.

Figure 10:
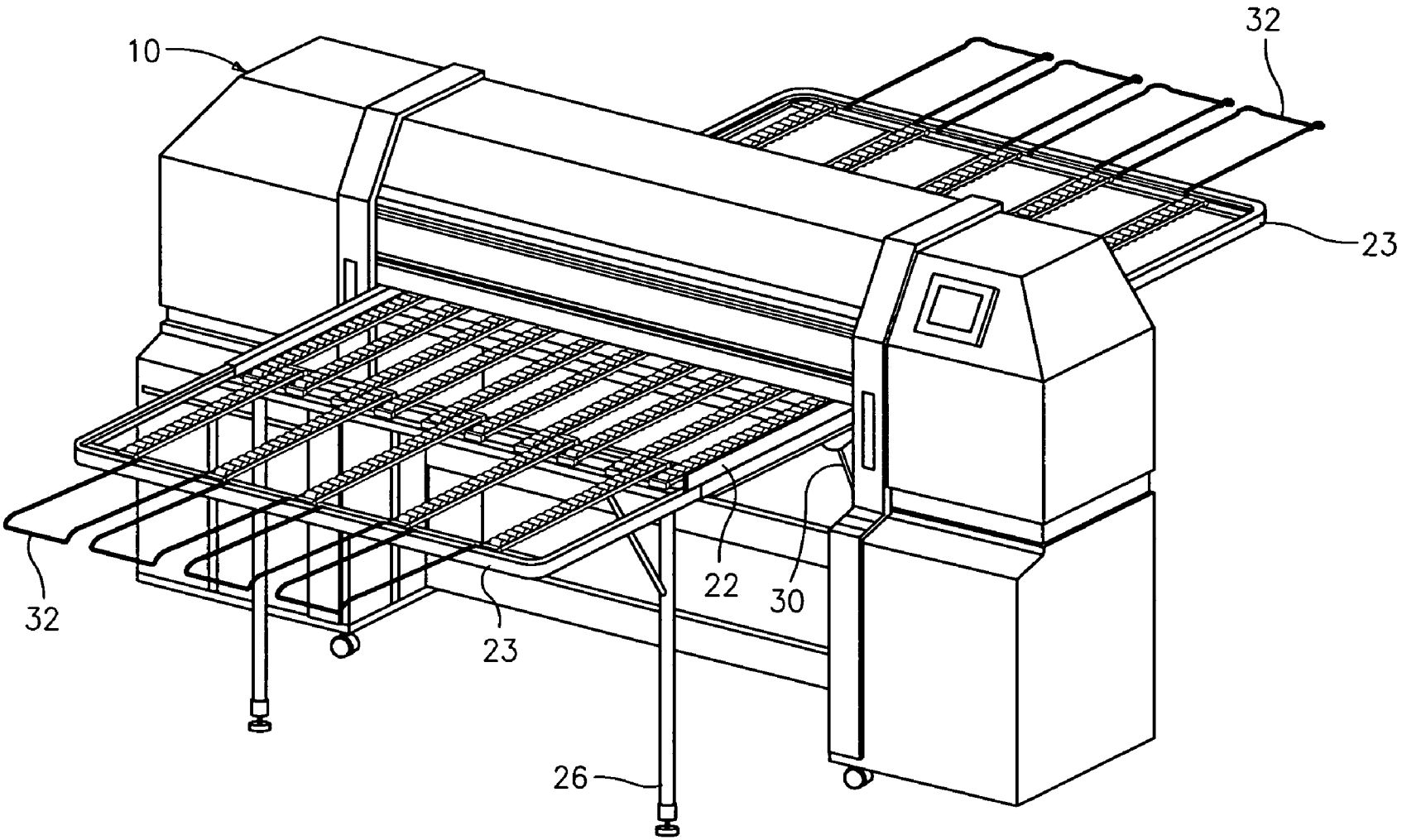
FIG. 10 depicts a different view of the table assembly in accordance with the present invention in which the table assembly is operably connected with the ink jet printer and is fully extended.

Traditionally, ink jet printers for rigid media have not been integrated into an office environment because they take up too much floor space. The present invention provides for at least one table assembly which is integrated directly into the printer and can be folded tightly against the printer when not in use. The table assembly of the invention comprises a plurality of leaves that can be extended to provide a large workspace for various media. In a preferred embodiment, the at least one table assembly 20 comprises two table assemblies—a first table assembly mounted on an input side and a second table assembly mounted on an output side of the printer assembly 10, as seen in FIGS. 4 and 10.

The table assembly 20 of the invention mechanically folds flat for storage when not in use. The table assembly 20 typically comprises rigid metal framing with a plurality of rollers for advancing the print media through the printer apparatus 10. The table assembly 20 provides the capability to handle rigid material such as corrugated media and thick foamed substrates as well as very thin media that are not self-supporting.

Figure 4:
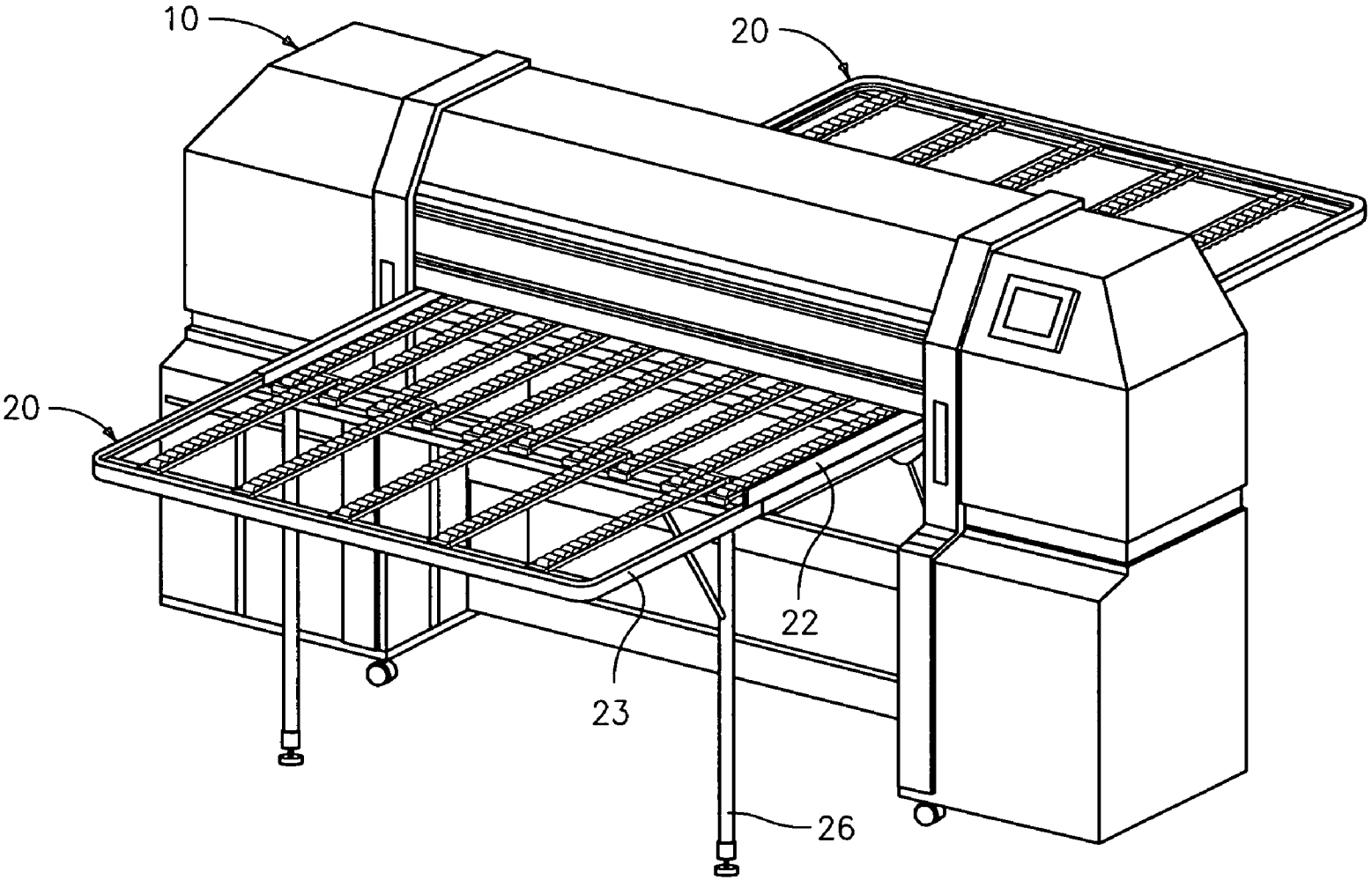
FIG. 4 depicts a first view of a table assembly in accordance with the present invention.
Figure 5:
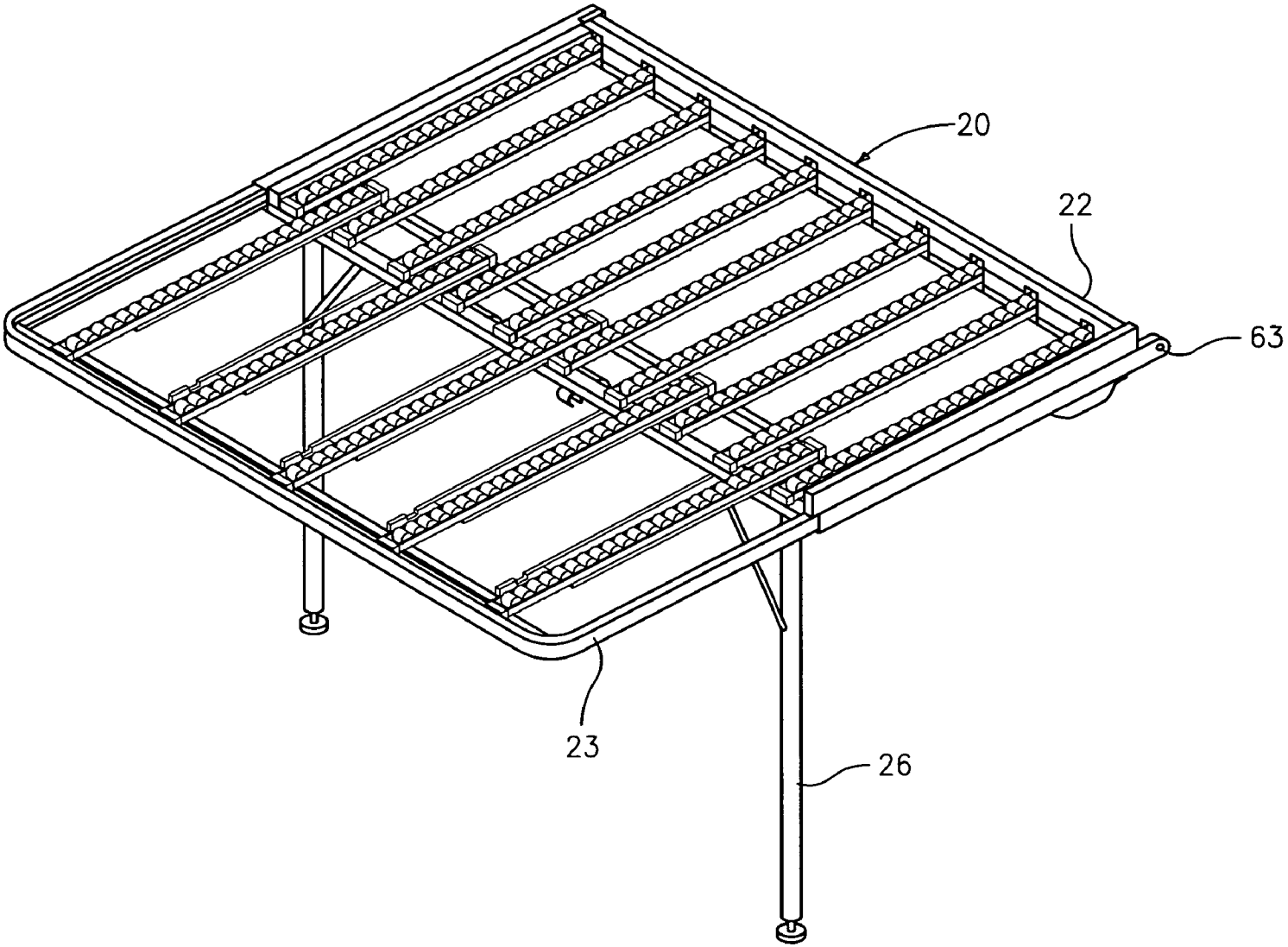
FIG. 5 depicts a view of the table assembly of the present invention not connected to an ink jet printer and depicts the table in a partially extended state.
Figure 6:
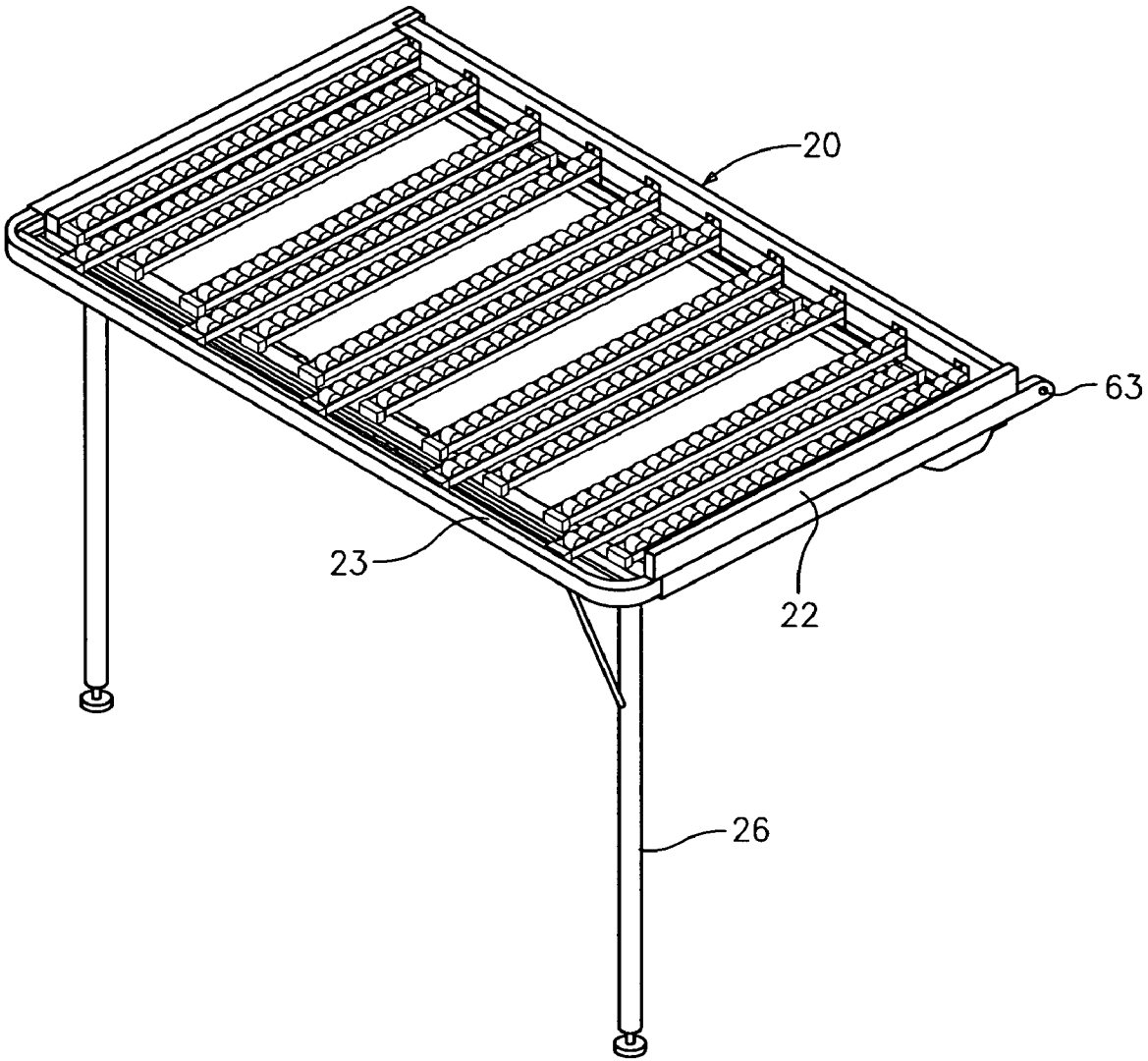
FIG. 6 depicts a different view of the table assembly of the present invention in which the table is in a collapsed state with the legs extended.
Figure 7:
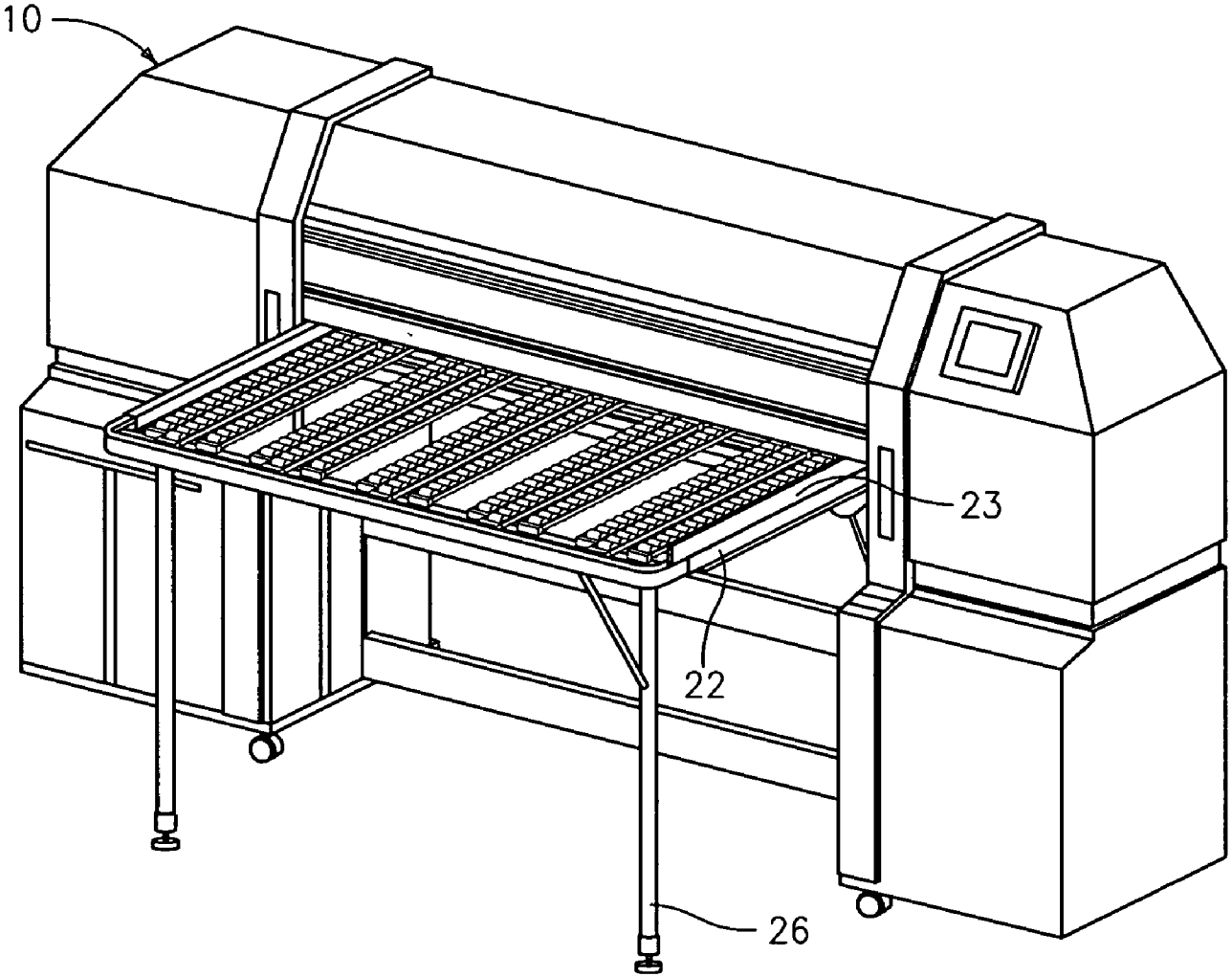
FIG. 7 depicts a different view of the table assembly in a collapsed state with the legs extended operably connected to an ink jet printer in accordance with the present invention.

FIGS. 4-10 depict various views of the table assembly 20 in accordance with the present invention As seen in FIG. 4, the ink jet printer 10 of the invention in one embodiment comprises a table assembly 20 that is attached to and integrated with the ink jet printer 10 of the invention. In this embodiment, two table assemblies are shown, a first table assembly on the input side and a second table assembly on the output side of the printer 10. Table assembly 20 can also be extended to provide for a larger workspace for the media being printed in the ink jet printer 10 of the invention. The table assembly 20 is also self-aligned and provides a work surface that is flush with the platen assembly 40, even in an extended state.

As seen in FIGS. 4-7, the at least one table assembly 20 comprises a first leaf 22 that is rigidly attached to the printer 10 at pivot point 63 and is coupled to platen assembly 40 at roller shaft 64. A second leaf 23 is slidably attached to the first leaf and is capable of sliding relative to the first leaf 22 to extend the length of the table in a first direction to provide a larger work surface. At least one leg 26 is used to provide stability for the table assembly 20. In one embodiment, as seen in the figures, the at least one leg 26 comprises two legs that are attached proximate to a first end of the first leaf 22 adjacent to the second leaf 23. The attachment location of the at least one leg 26 is not critical and is a design choice which would be within the purview of one skilled in the art. In addition while two legs 26 are depicted in the drawings, the invention is not limited to two legs. For example, a single leg may be provided at a midpoint of the first leaf 22. In the alternative three or more legs may be used depending on the weight and size of the media being printed.

The table assembly 20 is fixably attached to the platen assembly 40 at the roller shaft 64 proximate to a point adjacent to a second end of the first leaf 22 and is self-alignable at a point where it interfaces with the platen assembly 40. The at least one leg 26 is pivotally mounted to the table assembly 20 so that the at least one leg 26 can be folded flush against the leaves of the table assembly 20 for storage and the at least one leg 26 can be unfolded to set up the table assembly 20 for supporting the print media during printing.

As seen in FIG. 10, in one embodiment, the second leaf 23 comprises a plurality of extension portions 32 that are capable of sliding out from the end of the leaf opposite the first leaf 22 to extend the length of the table assembly 20. In a preferred embodiment, the plurality of extension portions 32 are U-shaped wings. This second extension capability can be used if the media is not self-supporting, i.e., a non-rigid media to further extend the length of the table.

Figure 8:
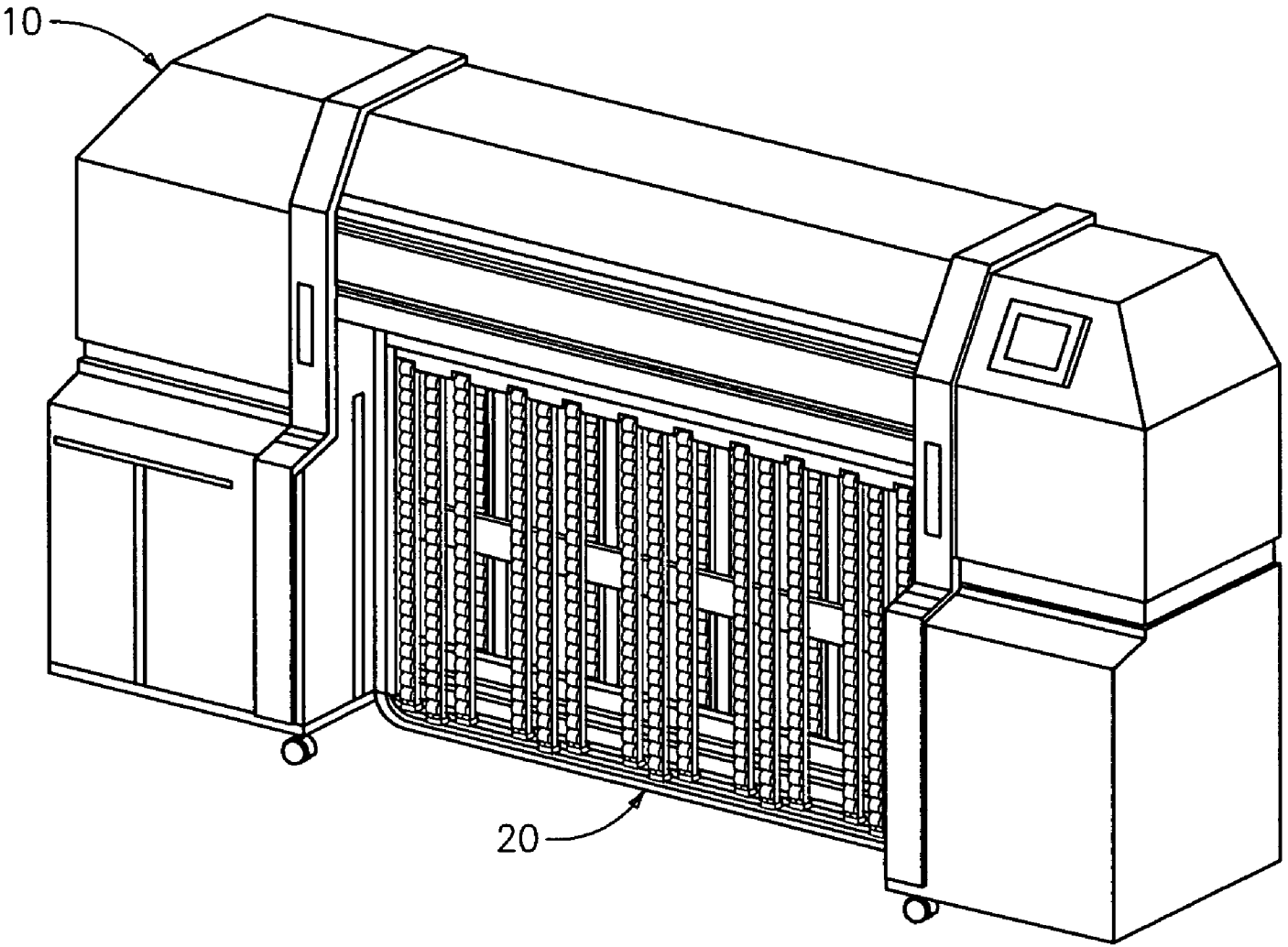
FIG. 8 depicts a different view of the table assembly operably connected to an ink jet printer in which the table assembly is folded against the ink jet printer in accordance with the present invention.
Figure 9:
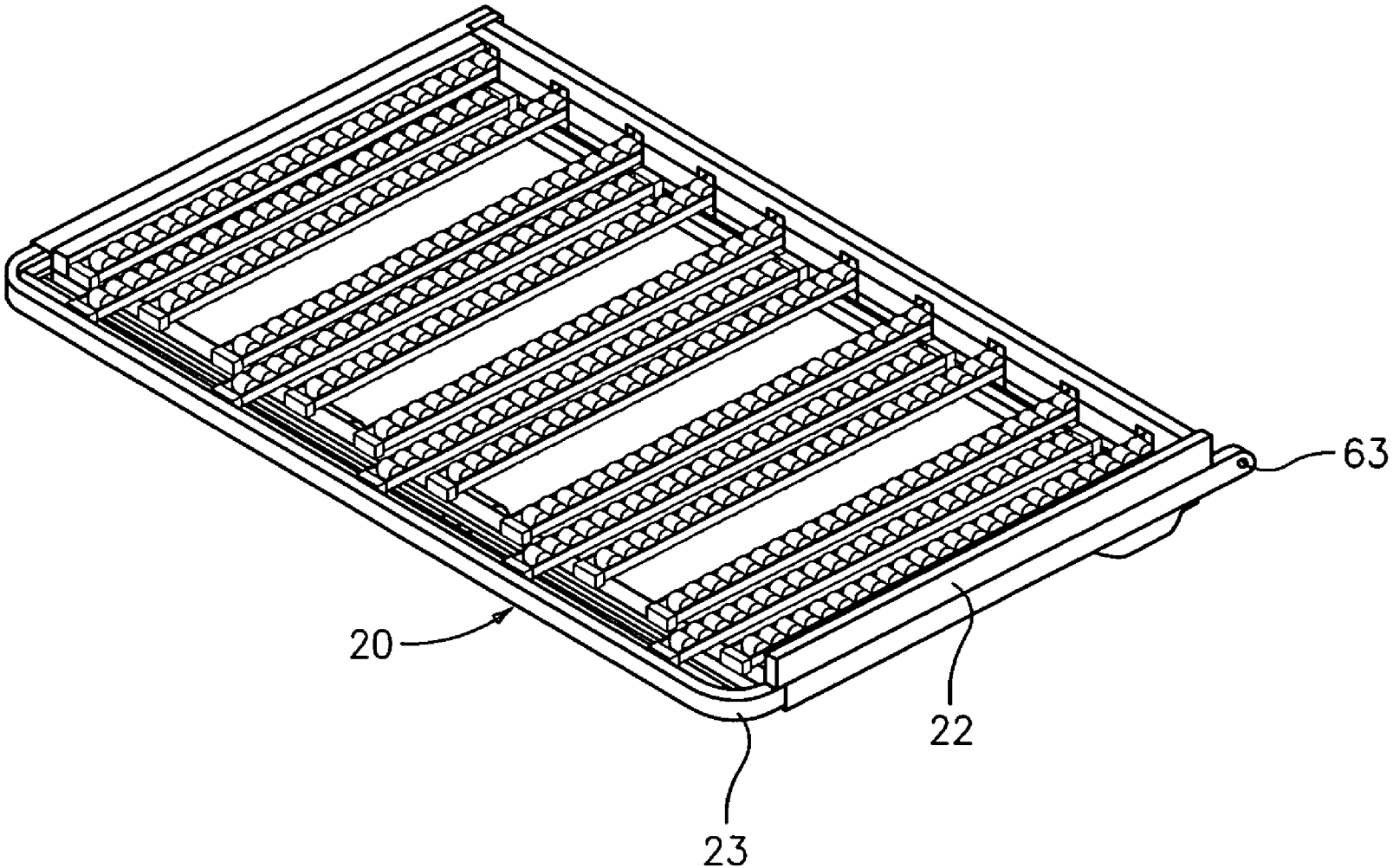
FIG. 9 depicts a view of the table assembly of the present invention in a collapsed state.

FIG. 8 depicts a view of the table assembly 20 that shows the table assembly 20 folded for storage against the printer apparatus 10. As discussed above, in a preferred embodiment, two table assemblies are used for the input and output sides of the printer and the two table assemblies can both be folded for storage flush against the side of the printer 10. FIG. 9 depicts another view of the table assembly 20 of the invention that depicts the first leaf 22, the second leaf 23 in a collapsed state.

Figure 11:
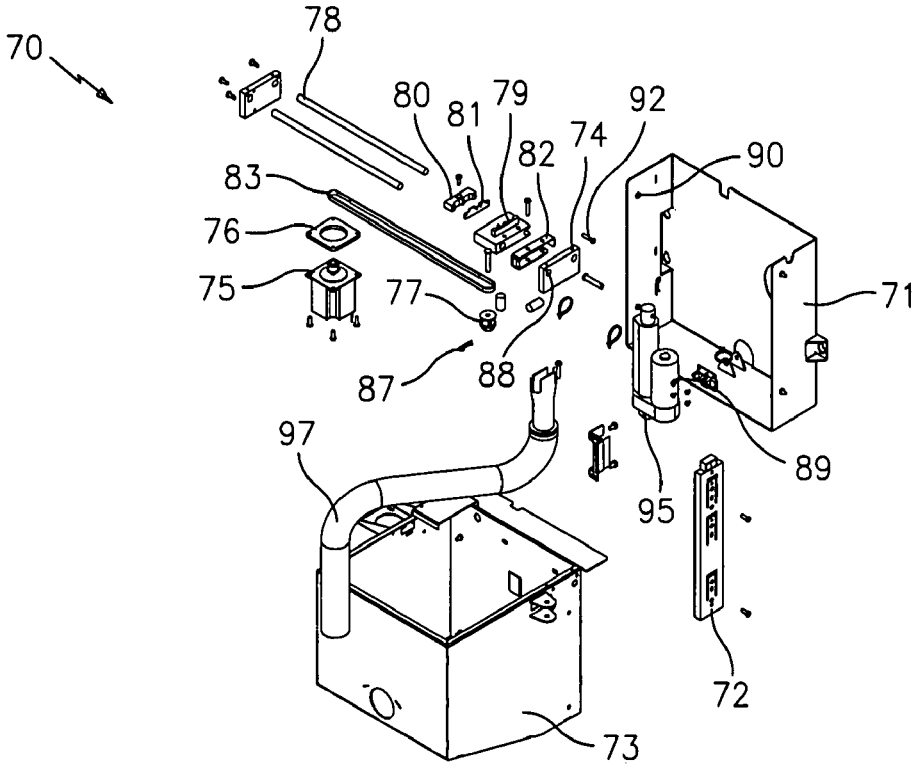
FIG. 11 depicts an exploded view of a service station assembly in accordance with the present invention.
Figure 12:
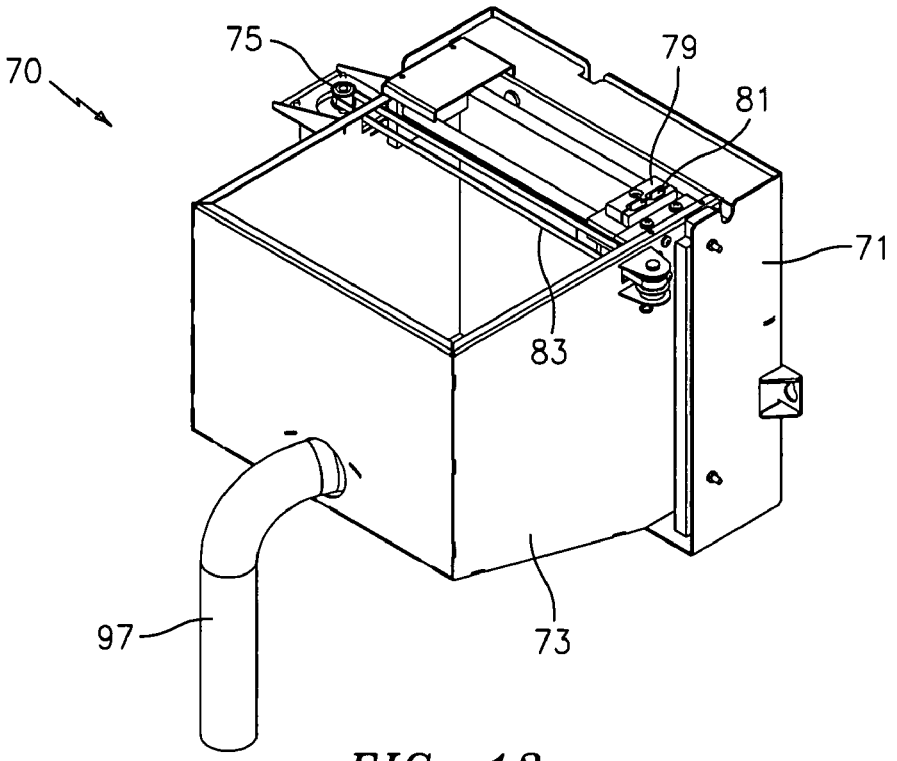
FIG. 12 depicts a different view of a service station assembly in accordance with the present invention.

The printer apparatus 10 of the invention also includes an improved service station assembly 70 as seen in FIGS. 11 and 12 in order to clean or "service" the inkjet printheads 200 during printing. One benefit of the improved service station assembly 70 of the invention is that it does not require any user interaction for the life of the printer apparatus at the print head location. Examples of service station assemblies are described in U.S. Pat. No. 7,052,106 to Onuma et al., and U.S. Pat. No. 6,789,876 to Barclay et al., the subject matter of each of which is herein incorporated by reference in its entirety.

The service station assembly 70 is stationary and is mounted at one end of the platen assembly 40. The location of the service station assembly 70 is not critical so long as the service station assembly 70 is mounted on a first end or a second end of the platen assembly 40.

The improved service station assembly 70 of the present invention cleans the inkjet printheads 200 in two ways—the service station assembly 70 includes both a wiping feature and a high velocity air flow as described in more detail below in order to provide more efficient cleaning of the inkjet printheads 200. Over time, jets of the inkjet printheads 200 can become clogged, leading to failure of the jet to eject ink. While wipers have commonly been used in service station assemblies for cleaning inkjet printheads 200, the use of a wiper by itself can leave residue on the inkjet printhead which can result in marks on the print media due to incomplete cleaning.

In addition it would also be desirable to have a service station assembly that can be brought into contact with the printhead to be serviced and then moved back out of the way so as not to interfere with thicker print media being printed and also to allow for servicing of the inkjet printheads during the printing operation while the print media remains in place.

The present invention relates to various improvements in the service station assembly to more effectively clean the inkjet printheads and to allow the service station assembly to service the inkjet printheads during the printing operation as is seen in FIGS. 11 and 12 and as described in more detail below.

As depicted in FIGS. 11 and 12, the service station assembly 70 of the invention includes a housing 73 for enclosing the components of the service station assembly 70. As seen in FIG. 12, the housing 73 is open at the top of the housing. The service station housing 73 is secured to a service station bracket mount 71 with securing means 90, and the bracket mount secures the service station assembly to the printer chassis (not shown).

In a preferred embodiment of the present invention, the service assembly comprises a linear actuator 72 positioned between the service station housing 73 and the bracket mount 1 for moving the wiping means 79 up and down. The linear actuator 72 provides a means to adjust the height of the wiping means 79 based on the thickness of the loaded media, which, in some embodiments may be up to about 3-inches thick.

A motor assembly 95 is coupled to the linear actuator 72 to move wiper assembly 79 to the level of the printhead 200 and to return the wiper assembly 79 to its starting position.

The linear actuator 72 of the invention allows for servicing while printing—i.e., the media being printed does not need to be removed while print head is being serviced so there is no shifting of the print media. The linear actuator 72 allows for a loaded media thickness of up to at least about 1 inch in thickness.

The wiper assembly 79 is mounted on a precision guide 78 and reciprocates back and forth within the service station housing 73 by means of a belt 83 driven by a pulley driver motor 75. The wiper assembly 79 is fastened to guide 78 and to belt 83 with clip 82 and is secured through clip 82 with securing means 91. A fastening means 76 is used for mounting the belt 83 to pulley motor 75 on one end and to a timing belt mount 77 on the other end. The pulley motor and the timing belt mount 77 are secured through the service station housing 73. A mounting plate 74 is secured to the service station housing 73 with securing means 88 and 92 and provides a stop for the wiper assembly 79.

The wiper assembly 79 comprises a wiper mount 80 coupled to a wiper blade 81. As seen in the figures, the wiper mount 80 has an indent in the side thereof that is coupled to the wiper blade 81. This indent creates a space to allow high velocity air to pass by the wiper blade 81 to assist with removal of debris from the inkjet printhead 200. A vacuum hose 97 coupled to an air source (not shown) provides the high velocity air to the wiper assembly. In one embodiment, the high velocity air is provided at a velocity in excess of 3000 feet per minute at the tip of the wiper blade. The inventors have found that the use of high velocity air in combination with the wiper blade 81 improves the cleaning ability of the wiper blade 81 and provides significantly cleaner inkjet printheads 200 over prior art wiping elements.

Figure 13:
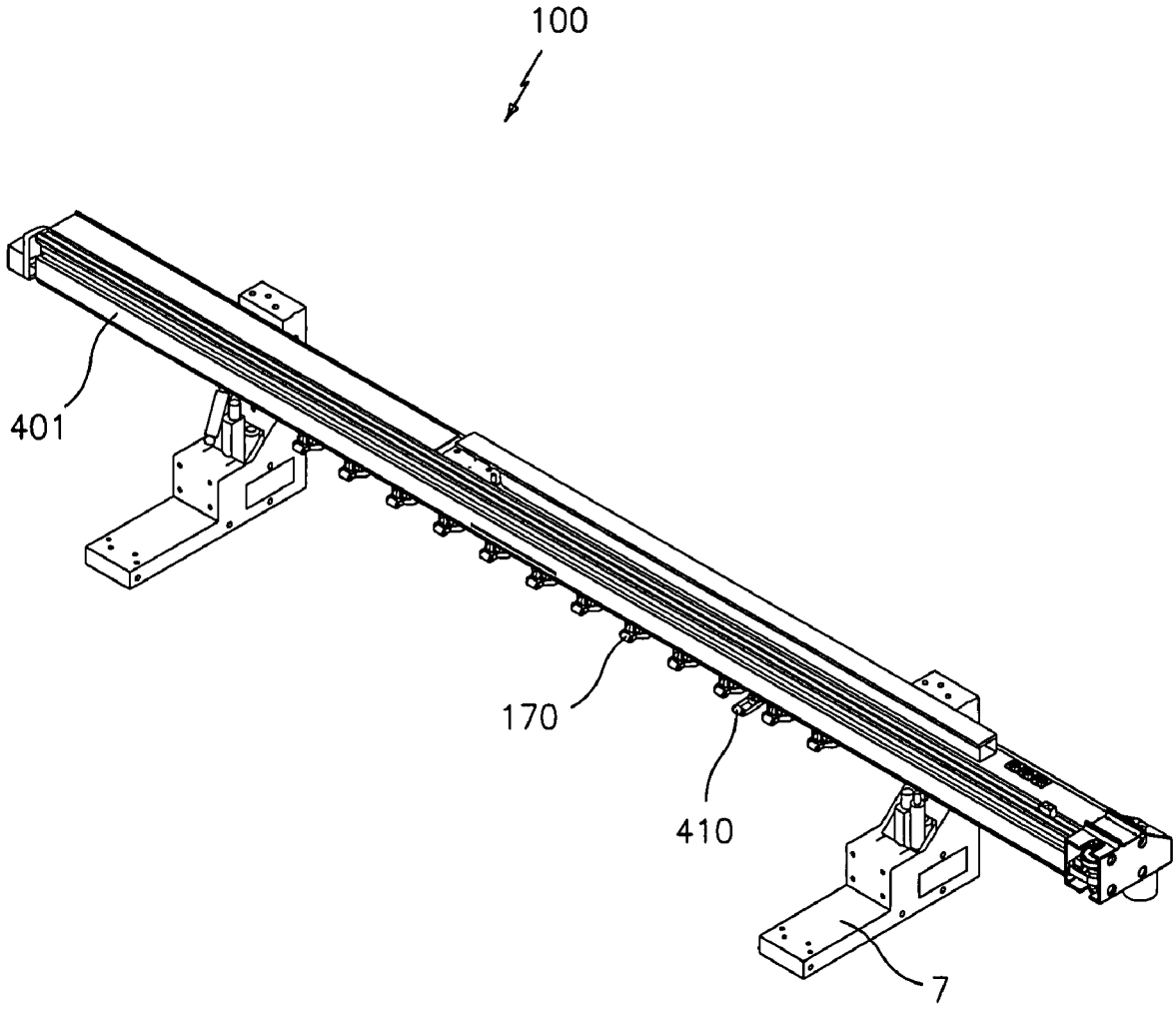
FIG. 13 depicts a first view of a rail assembly in accordance with the present invention.
Figure 14:
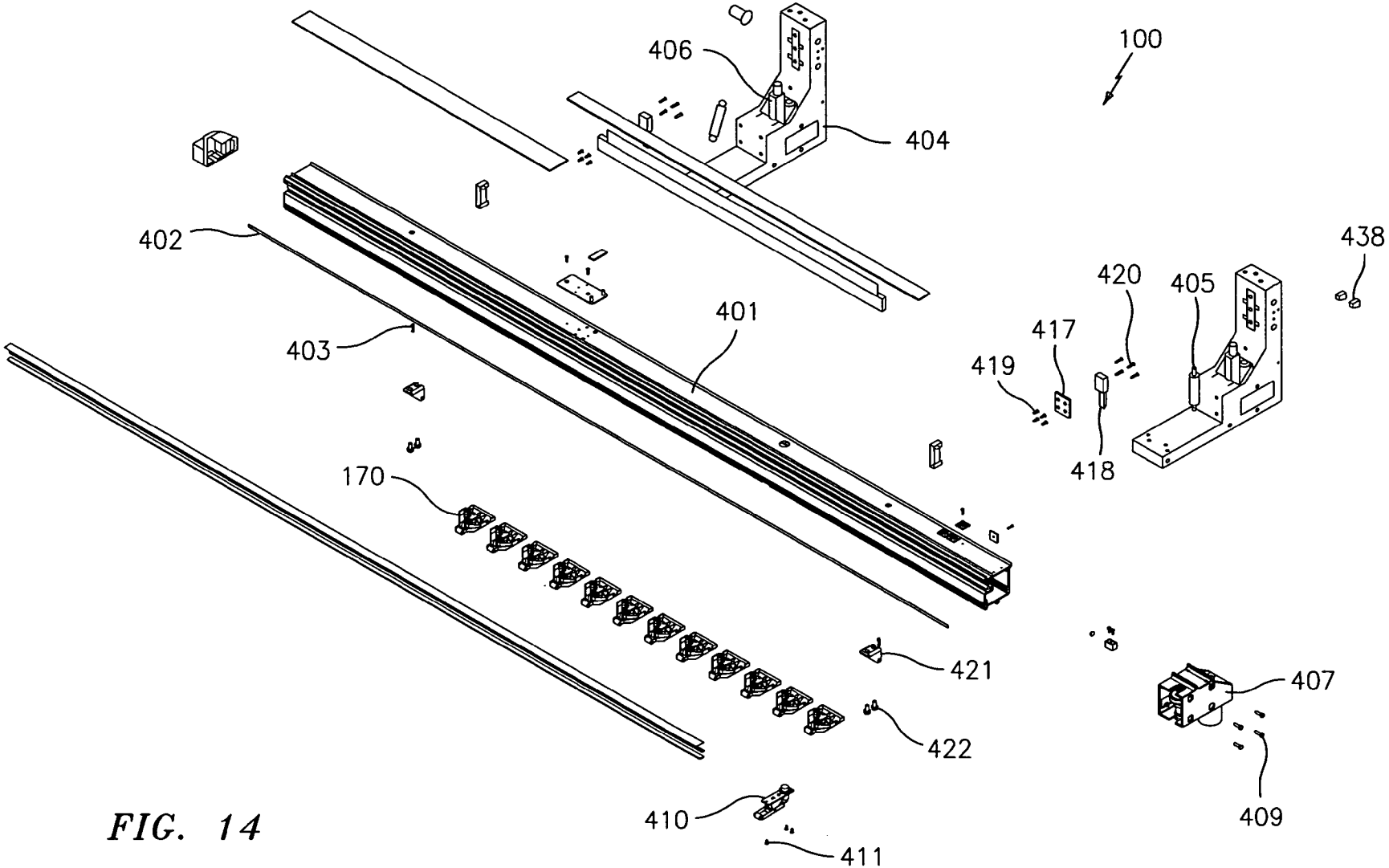
FIG. 14 depicts an exploded view of the rail assembly in accordance with the present invention.

FIGS. 13 and 14 depict various views of the rail assembly 100 in accordance with the present invention. The rail assembly comprises the rail on which the printhead assembly moves over the print media. The rail assembly is mounted adjacent to platen assembly 40 above the print zone 50.

The rail assembly 100 of the present invention includes an improved height adjustment assembly 406, which is a hydraulic or screw activated height adjuster that adjusts to different thickness of the substrates, which for example may include paper, corrugated media, and plywood. A novel feature of the height adjustment assembly 406 of the invention is that the entire rail is adjusted. Previously, the height of the platen or printing media or even the printhead itself was adjusted.

The present invention comprises an accurate and simple way of determining the required height of the rail assembly.

Various features of the rail assembly 100 are depicted in FIGS. 13 and 14. As seen in FIG. 14, the rail assembly 100 of the invention comprises external rail 401, which is preferably made of extruded aluminum with sufficient stiffness to prevent twisting and bending under the weight of the carriage assembly. Bearing strips 402 slide into grooves in the external rail 401 and are secured in place with securing means 403. Bearing strips 402 are stainless steel and provide precision performance with lower cost.

The external rail 401 is supported by chassis 404, which comprises a plurality of L-brackets 404. A plurality of springs 405 are used along with a plurality of height adjustment assemblies 406 to support and adjust the height of the external rail 401 on the chassis 404. In addition, the external rail 401 is mounted to the chassis 404 by means of a mounting rail 417 connected to a miniature linear guide 418 which is in turn secured to the chassis 404 with securing means 419 and 420.

External rail also comprises a carriage driver motor 407 that drives reciprocating carriage assembly 60.

In addition, a plurality of pinch rollers 170 are mounted the underside of external rail 401 and are discussed in more detail below. In addition, a media thickness assembly 410 is also mounted to the underside of external rail 401 and is secured in place with fastening means 411 to measure the height of pinch rollers 170 on the surface of the print media. The media thickness assembly of the invention is a lever assembly 410 comprising an analog sensor for measuring height of the pinch rollers 170 on the surface. Previously, media thickness assemblies used ultrasonics for measuring the height, which was not as accurate or laser interferometry, which was much more costly. A mounting bracket 421 is also secured to the underside of external rail 401 with securing means 422.

Figure 15:
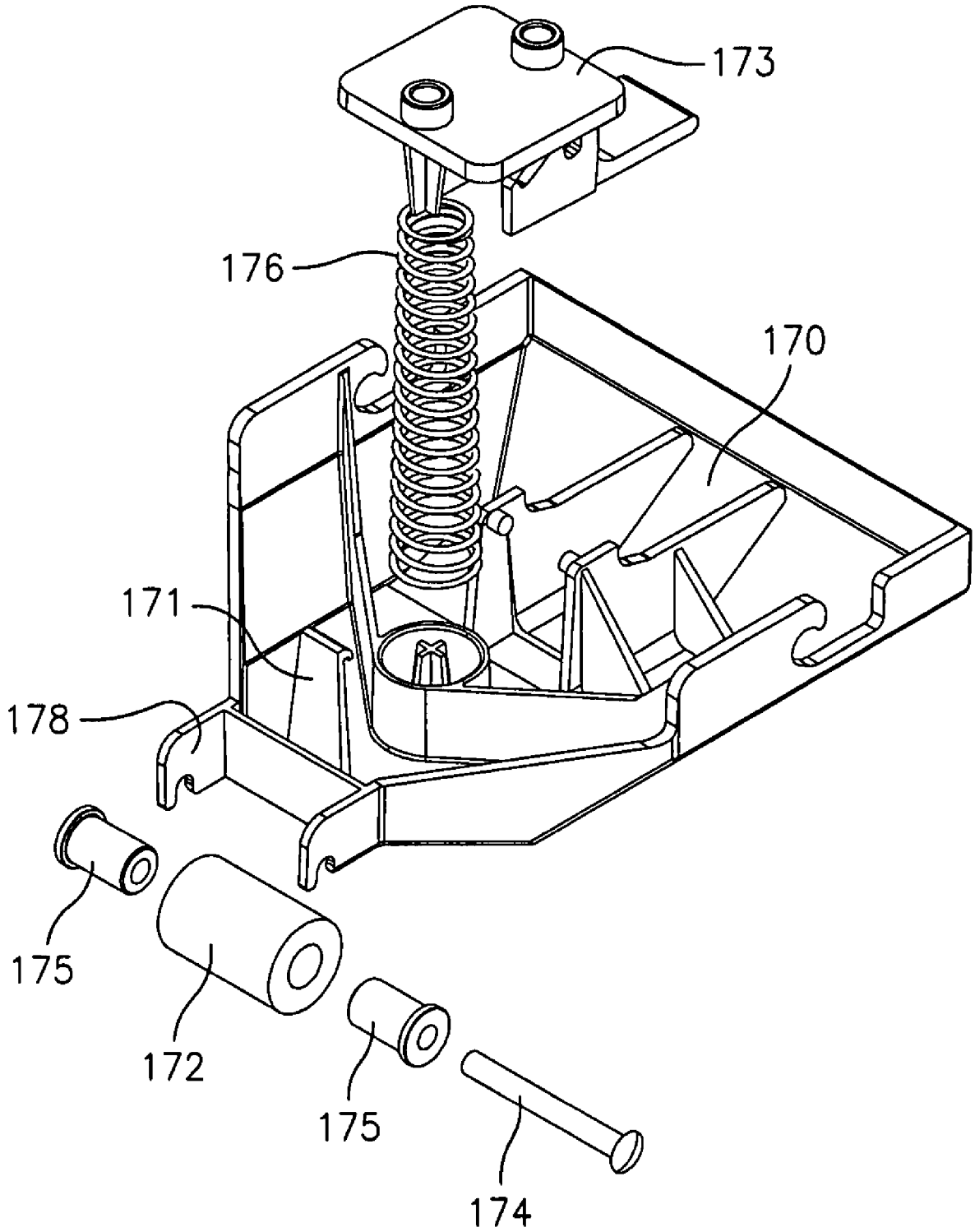
FIG. 15 depicts an exploded view of a pinch roll assembly in accordance with the present invention.
Figure 16:
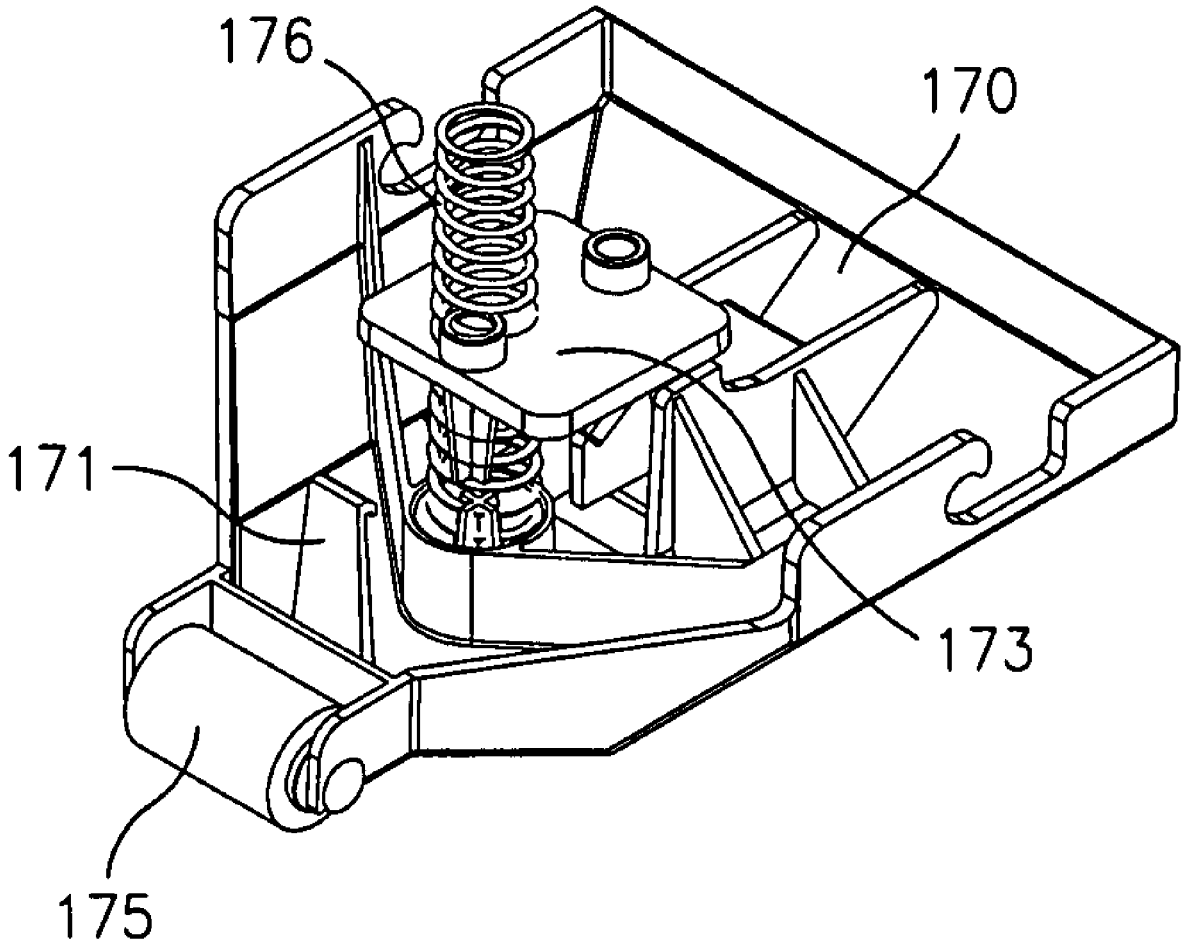
FIG. 16 depicts a different view of the pinch roll assembly in accordance with the present invention.

FIGS. 15 and 16 depict a pinch roller assembly 170 in accordance with the present invention.

The pinch roller assembly 170 has a locking feature that comprises a molded clip 171 that is mountable to a corresponding feature on extruded rail 401. When the user wants to move the pinch roller assembly 170 out of the way so that the pinch rollers 172 do not touch the print surface, the pinch roller assembly 170 is clipped to the extruded rail 401 with the molded clip 171. While the figures depict a molded clip, the invention is not limited to the embodiment shown. The invention is open to any locking means that is capable of moving the pinch roller out of the way using a means for releasably coupling the pinch roller assembly 170 to the extruded rail 401.

The pinch roller of the invention also has a snap-in feature that allows for it to be easily attached and detached in the system of the invention. As seen in FIG. 15, a rivet 174 is passed through locking means 175 on either side of roller wheel 172 to secure the roller wheel 172 into bracket 178. The rivet 174 is removable so that the roller wheel 172 may be replaced. This snap-in feature allows the user to change the configuration of the pinch roller wheel 172. For example, in many embodiments, a rubber pinch roller wheel is used. However, the rubber roller is electrically insulated and, on media where static charge build up is important, it would be beneficial to be able to remove the rubber roller and replace the roller with a different roller which is electrically conductive. For example, it may be desirable to replace the rubber pinch roller with a metal or electrically conductive pinch roller, especially when printing on electrically insulative media.

The pinch roller assembly 170 also comprises a compressible spring 176 held in place by a spring retainer 173. The spring 176 holds the pinch roller assembly 170 against the print media.

Another feature of the present invention relates to the inkjet printhead assembly, which includes features of the inkjet printheads as well as the curing assembly for curing UV-curable inkjet inks that are usable in the present invention.

Figure 17:
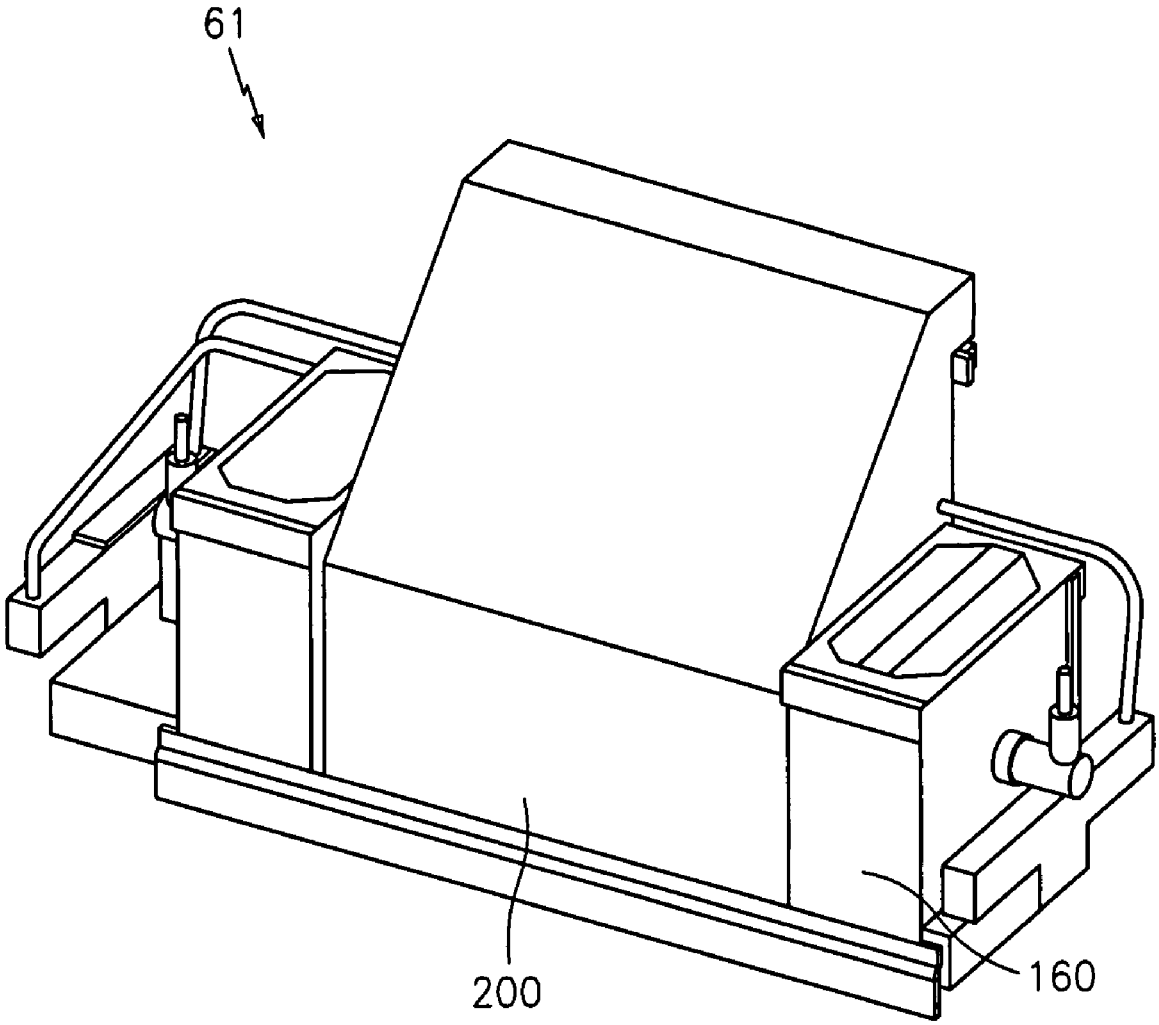
FIG. 17 depicts a view of a print head assembly in accordance with the present invention.

As seen in FIG. 17, the printer apparatus includes at least one inkjet print head assembly 61 which includes a plurality of inkjet print heads 200 for depositing inkjet ink, including UV-curable inkjet inks on a print media and at least one curing assembly 160 for curing the UV-curable inkjet inks when the ink is deposited on the printing media. The printer apparatus is mounted on scanning carriage 60 that is capable of traversing the width of the print media.

The printhead assembly 61 is operable to simultaneously print ink of different colors. Preferably, the printhead assembly has at least four sets of printheads that are in communication with at least four corresponding ink sources. As a result, the printhead assembly is operable to simultaneously print at least four inks of different colors so that a wide color spectrum in the final printed image can be achieved.

Figure 20:
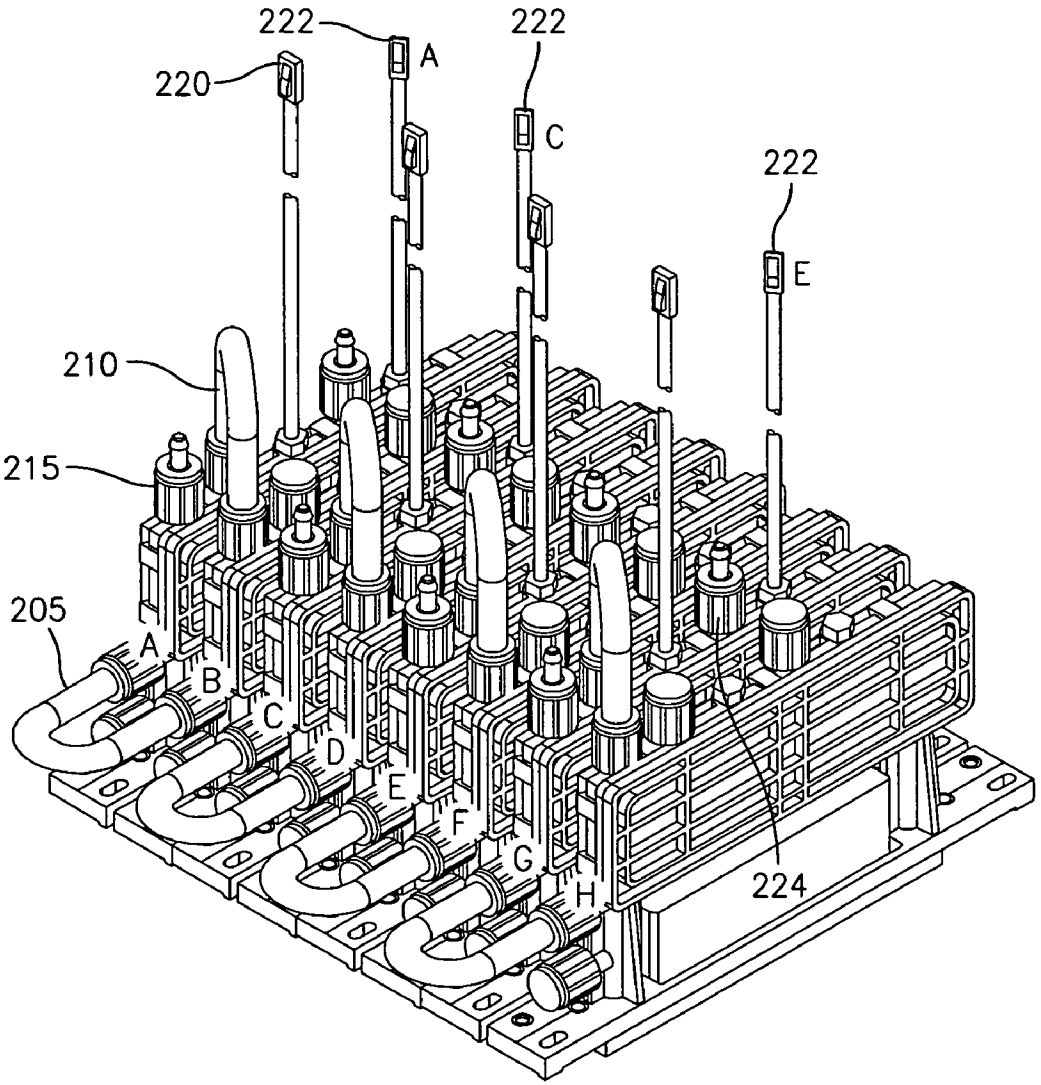
FIG. 20 depicts a view of a printhead having a two-by, four-color configuration.
Figure 21:
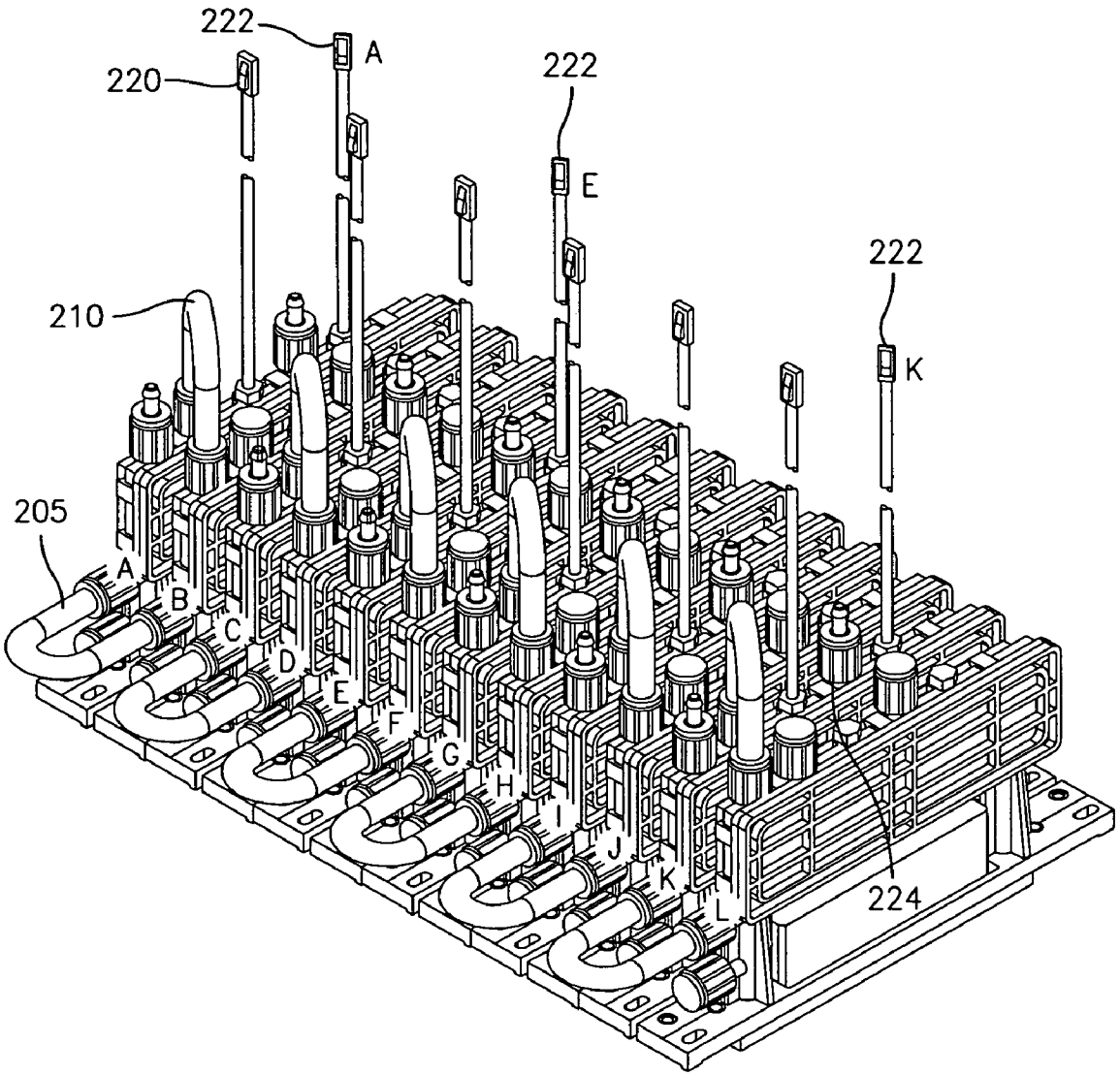
FIG. 21 depicts a view of a printhead having a two-by, six color configuration.

Printhead configuration varies by printer model and manufacturer, however many printers are configured as either one printhead per color or two printheads per color. This is sometimes referred to as a one-by or a two-by configuration respectively. By way of example and not limitation, various examples of printhead configurations are descried in FIGS. 20-21.

Figure 18:
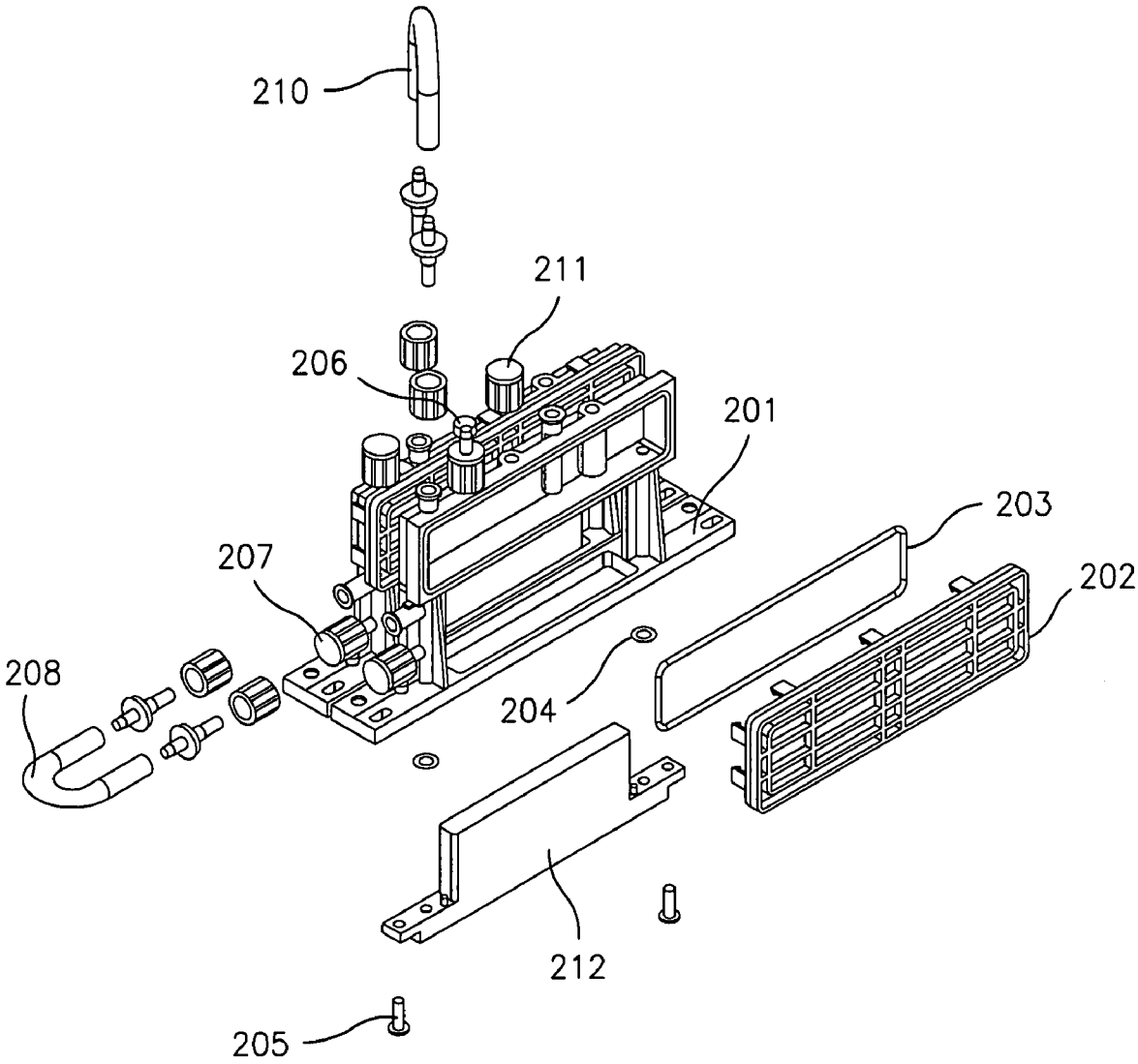
FIG. 18 depicts an exploded view of a printhead usable in the print head assembly in accordance with the present invention.
Figure 19:
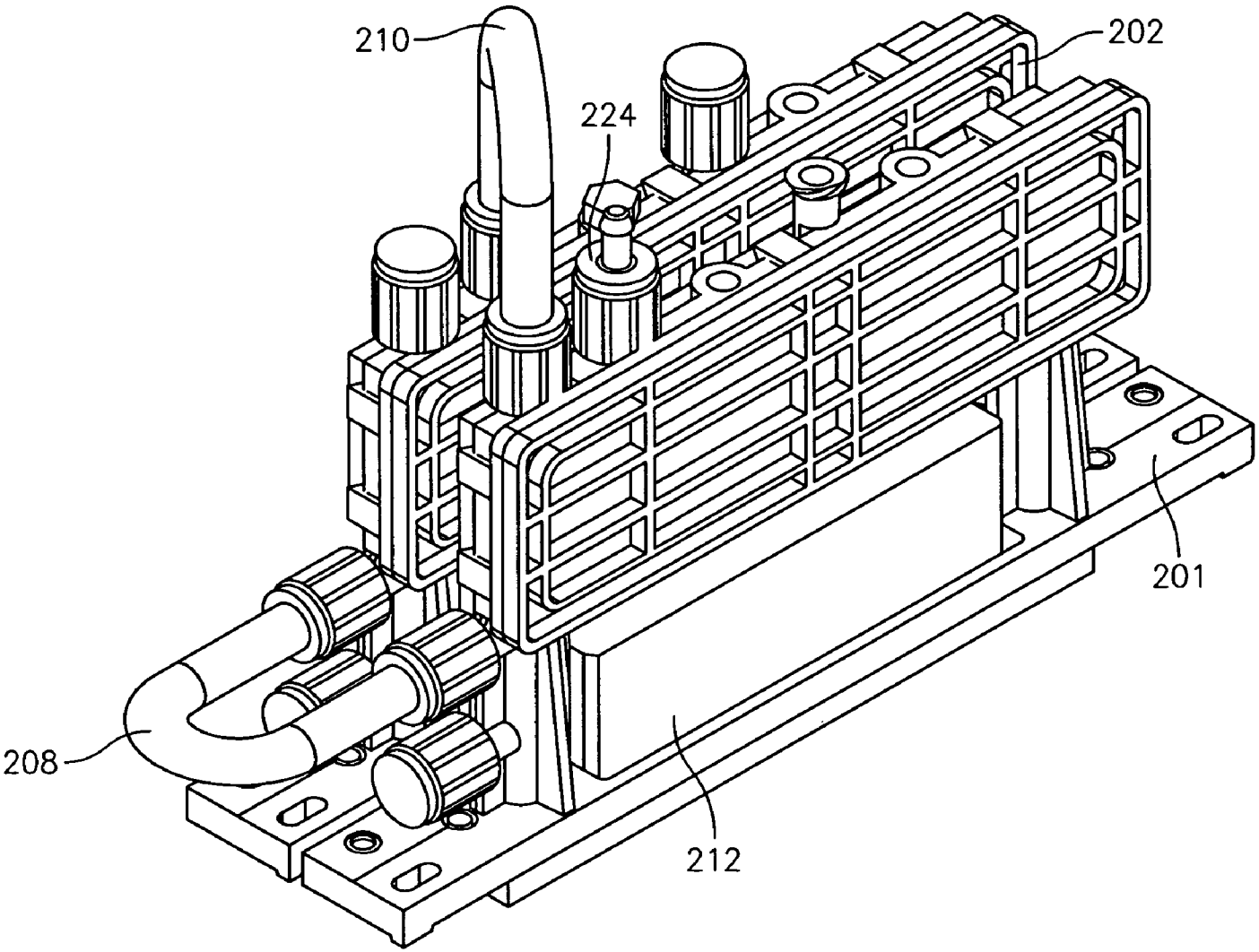
FIG. 19 depicts another view of the printhead in accordance with the present invention.

FIGS. 18 and 19 depict various views of the improved inkjet printhead 200 usable in the printhead assembly 61 of the invention.

In general, each inkjet printhead 200 includes an integrated, sealed assembly closed to atmosphere and equipped with internal cavity containing an initial quantity of ink. It is typically necessary to monitor the conditions of an inkjet printhead 200 so that the printhead does not run out of ink. A typical means for monitoring the conditions of the printhead 200 involves the use of air and ink thermistors to sense and monitor the environment in the printhead 200. Previously, it was believed that each printhead 200 required its own separate air thermistor and own separate ink thermistor. The inventors of the present invention have determined that it is possible to reduce the number of air thermistors in the inkjet printhead assembly 150 while still achieving the same level of monitoring, thus realizing an advantage in assembly as well as cost.

FIGS. 18 and 19 depict a view of one color of a two-by printhead element 200, having two printheads with two jetting devices, which in the preferred embodiment are piezo elements 212. As seen in FIGS. 18 and 19, each printhead comprises a penholder reservoir 201 coupled to a cover 202 for the penholder reservoir 201. The piezo element 212 is mounted in the ink reservoir 201 to jet the fluid, i.e., inkjet ink onto the print media and is secured using suitable fastening means 205 (i.e., screws) and an O-ring 204 between the ink reservoir and the piezo element 212 for the fastening means 205 to provide a tight seal between the piezo element and the ink reservoir. Another seal 203 is provided between the reservoir 201 and the cover 202. Ink transfer tube 208 is used to maintain substantially the same level of ink in each ink reservoir 201 of the two-by printhead element. A vacuum U-tube 210 with an O-ring seal 206 is coupled to the top of the ink reservoir 201 and is used to maintain the vacuum level in the ink reservoirs 201. Vacuum port barbs 215 operatively connect via tubing (not shown) to a vacuum assembly, depicted in FIGS. 27 and 29-31. Ink port barbs 224 operatively connect to an off-head ink deliver system.

Figure 22:
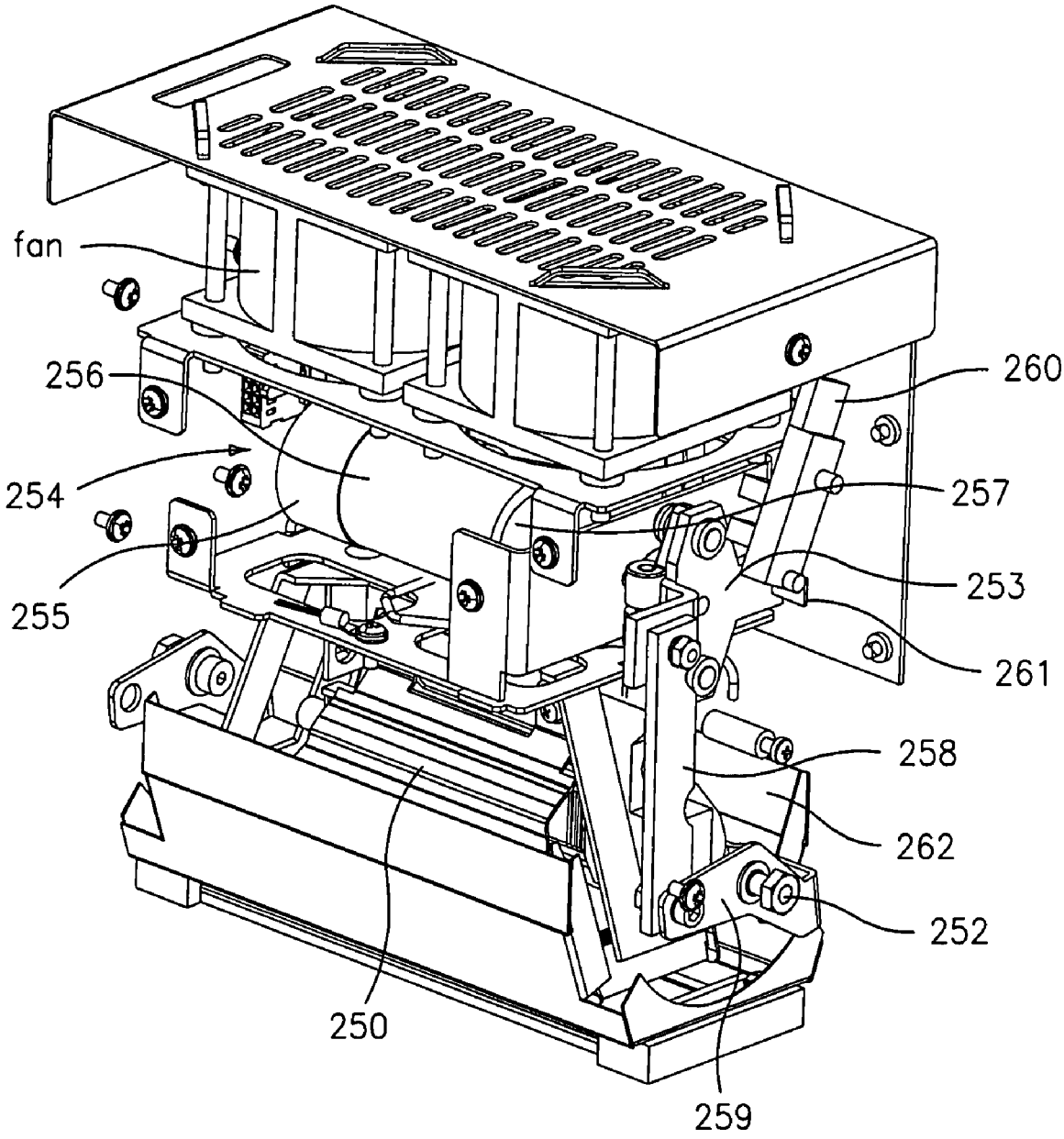
FIG. 22 depicts an isometric view of a curing assembly usable in the print head assembly of the present invention.
Figure 23:
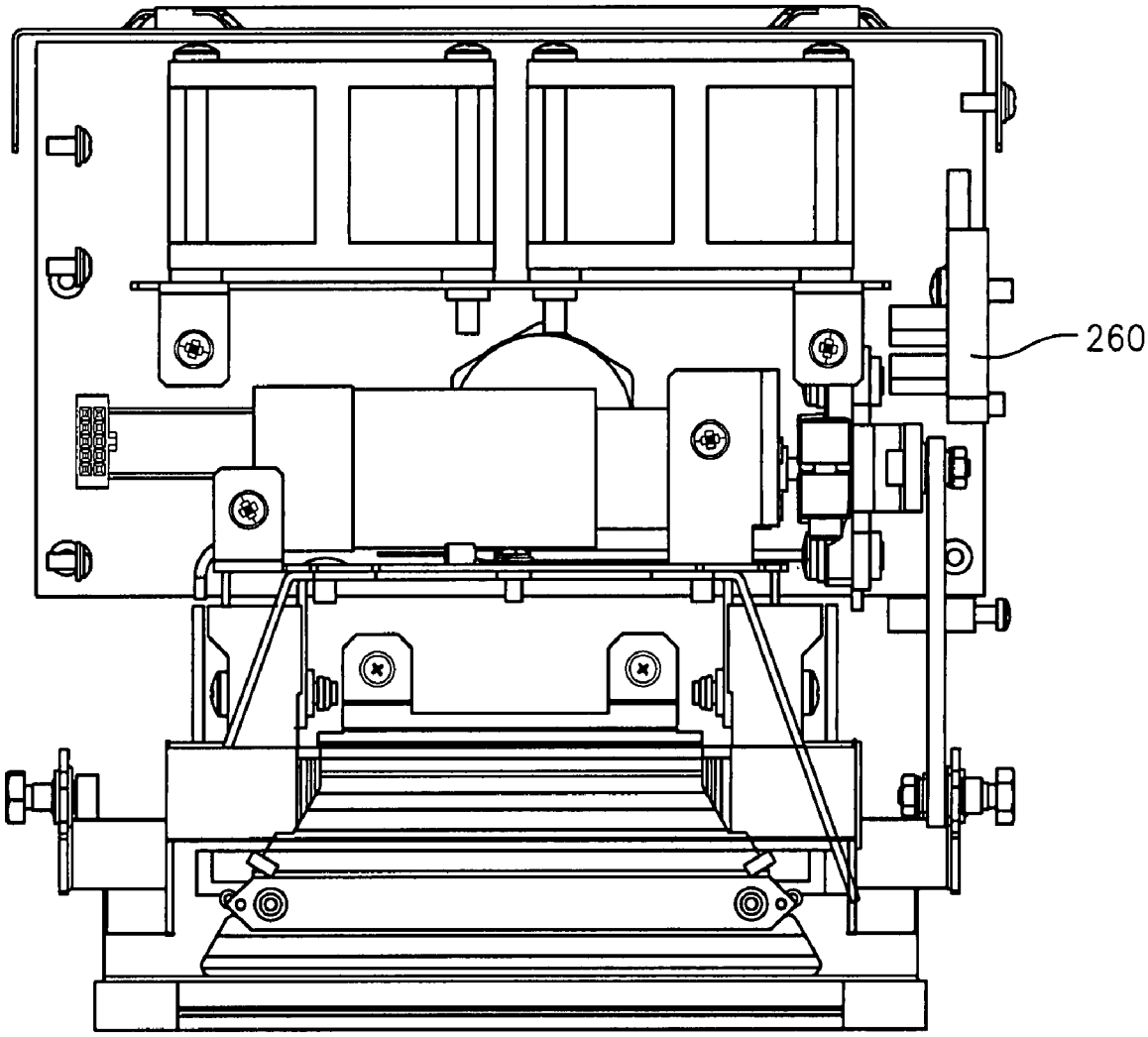
FIG. 23 depicts a front view of the curing assembly of the present invention showing a side view of the shutter.

FIG. 22 depicts the two-by, four color configuration with printheads black A and B, cyan C and D, magenta E and F, and yellow G and H. As seen in FIG. 22, three air thermistors 222 are used, for example being placed on printheads A, C, and E. FIG. 23 depicts the two-by, six color configuration with printheads black A and B, cyan C and D, magenta E and F, yellow G and H, light cyan I and J, and light magenta K and L, with three air thermistors 222, for example being placed on printheads A, E, and K.

The above placement and number of air thermistors are given by way of example and not limitation and one skilled in the art would be capable of selecting a suitable number and placement of the air thermistors 222. A feature of the present invention is that the number of air thermistors is independent of the number of ink thermistors employed. The required number of air thermistors is dependent solely on the air temperature variation in the carriage assembly 60.

The inkjet printhead assembly 61 of the invention includes an improved curing assembly 160 for curing the UV-curable inks as the ink is ejected onto the print media.

Sources of UV radiation include mercury lamps, xenon lamps, metal halide lamps, excimer lamps carbon arc lamps, tungsten filament lamps, lasers, LEDs, and the like. In addition, the source of UV radiation may provide a continuous or pulsed emission. In one preferred embodiment, the present invention uses a high pressure mercury bulb as the source of UV radiation. It is important for the source of acting radiation to remain fairly constant, and since many UV radiation sources do not immediately turn on/off, it is desirable for the UV radiation source to remain on during the printing process. However, if the source of the UV radiation remains on, it is necessary to restrict or change the direction of the beam of UV radiation to the printed area, for example, so that the ink is not cured in the orifices of the print head which could cause the print head to clog and/or malfunction.

Previously the source of UV radiation was controlled by shuttering either one side or the other of the light source. Examples of UV curing assemblies can be found in U.S. Pat. No. 6,543,890 to Ylitalo et al. and in U.S. Patent Publication No. 2003/0011670 to Shirakawa, the subject matter of each of which is herein incorporated by reference in its entirety. The drawback of these systems is that it is impossible to print all the way to the edge of the printing media while simultaneously preventing the source of UV radiation from exceeding a position at the edge of the media while the scanning carriage 60 reciprocates in both directions. To overcome these difficulties, the present invention uses a reflector that is capable of rotating biaxially.

Figure 26:
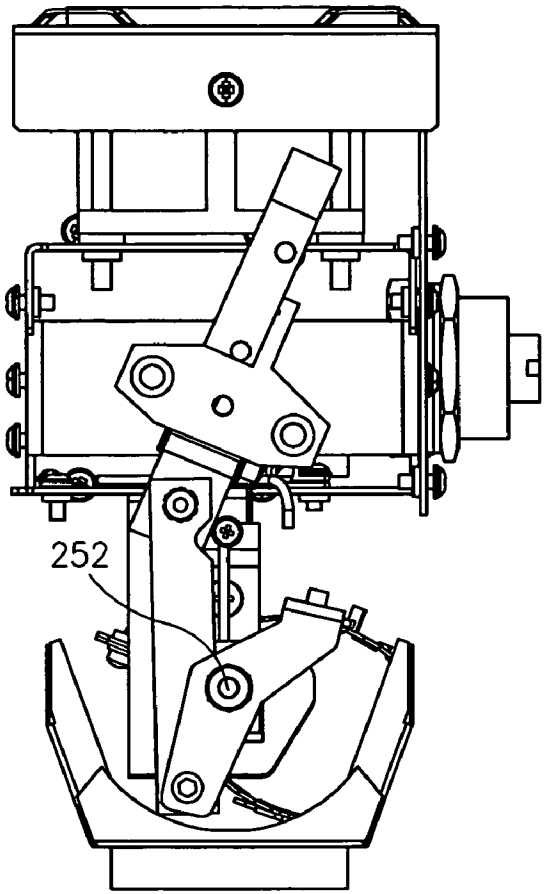
FIG. 26 depicts a front view of the curing assembly of the present invention and shows the shutter facing to the right.

The present invention utilizes a rotatable reflector 250 that is fixably mounted at the center line of a UV light 252 (shown in FIG. 26) (e.g., mercury bulb). The rotatable reflector 250 can be positioned in a number of positions to direct the UV light 252 in a desired direction. In a preferred embodiment the rotatable reflector 250 has a bell or parabolic shape as can be seen in the figures.

FIG. 22 depicts an isometric view of the UV curing assembly of the invention with the rotatable reflector 250 facing down in the direction of the printing media. A motor assembly 254 which comprises a relative encoder 255, an actuator motor 256, and a gear reducer 257 controls the position of the rotatable reflector 250. The motor assembly is coupled to a first arm 253, which is coupled to a second arm 258, and is then coupled to a third arm 259. A sensor 260, which in a preferred embodiment is a paddle-shaped slot sensor coupled to a flag 261, senses the location of the reflector 250 so that the position of the reflector 250 can be adjusted and controlled.

Figure 25:
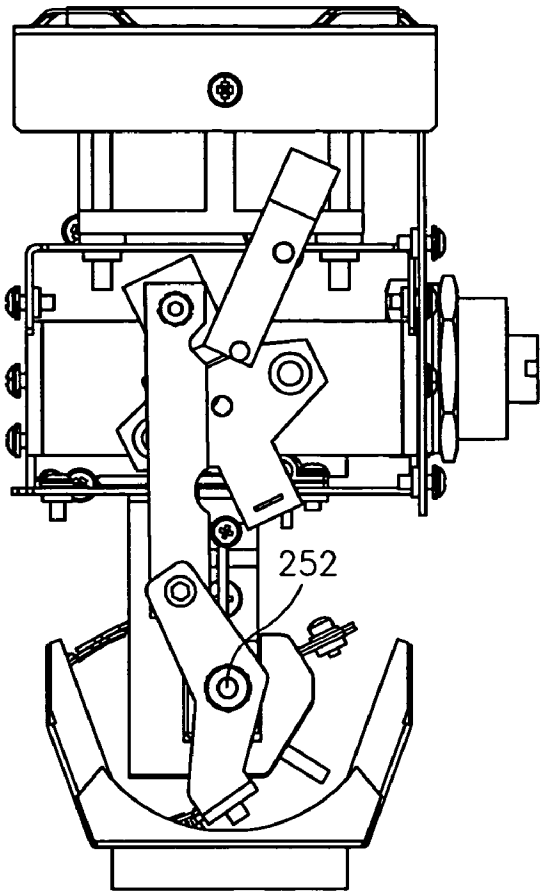
FIG. 25 depicts a front view of the curing assembly of the present invention and shows the shutter facing to the left.
Figure 24:
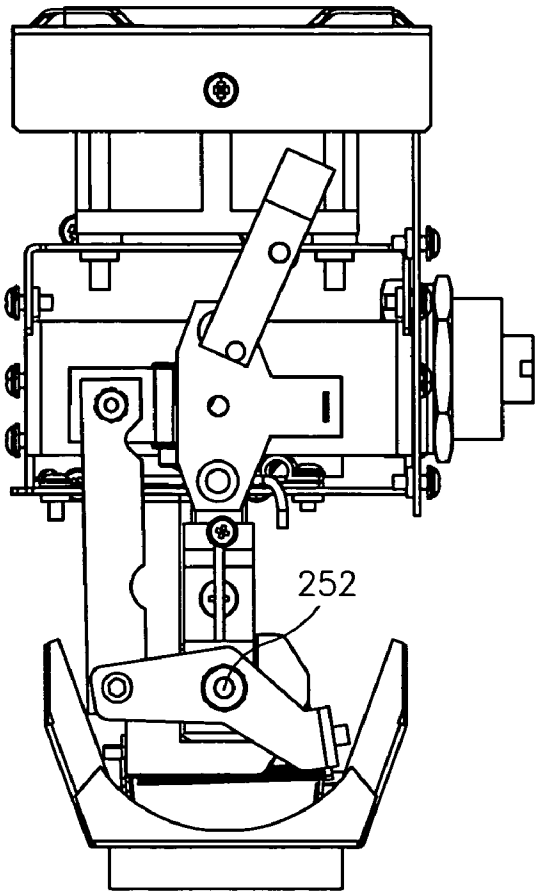
FIG. 24 depicts a front view of the curing assembly of the present invention and shows the shutter facing down.

For example, it is often desirable that the light 252 be directed straight down onto the printing media. As seen in FIGS. 22-24, the reflector 250 can be adjusted straight down so that the light is reflected onto the printing media. FIG. 25 shows a view of the curing assembly where the reflector 250 is rotated to the left to approximately the seven o'clock position and the light is reflected onto the housing 262 instead of the print media, so that the light is prevented from reaching the print media. Likewise in FIG. 26, the reflector 250 is rotated to the right to approximately the five o'clock position.

Another feature of the present invention is the ability to precisely control the dosage of light at the edge of the printing media. The reflector 250 can be rotated to any of a number of positions to allow for precise control of the dosage of light at the edge of the media. For example, when printing to the edge of the print media, it is possible to rotate the reflector to a position between the positions depicted in FIG. 26 (straight down) and FIG. 27 (to the left) or FIG. 28 (to the right). Thus, the reflector 250 can precisely direct light to the edge of the print media. In addition, because the reflector 250 of the present invention is capable of bi-modal articulation, it is possible to cease exposure at the edge of the media while printing bidirectionally.

The rotating reflector 250 is positionable in a large number of positions which enables the user to control the aperture (i.e., the amount of light being directed towards the print media) by controlling the position of the reflector. Thus, the user is able to better control the cure rate of the ink and thus the gloss of the printed ink.

Another feature of the present invention is described in FIGS. 27-31 and relates generally to a vacuum assembly used to control the vacuum pressure above the ink in the inkjet printheads 200.

The vacuum assembly is typically used to control the vacuum pressure above the ink in the ink jet printheads 200. The ink is delivered to the nozzle under sufficient pressure to form a meniscus at the nozzle but not high enough to produce flow through the nozzle. This feature is described for example in U.S. Pat. No. 4,339,763 to Kyser et al., the subject matter of which is herein incorporated by reference in its entirety.

Figure 28:
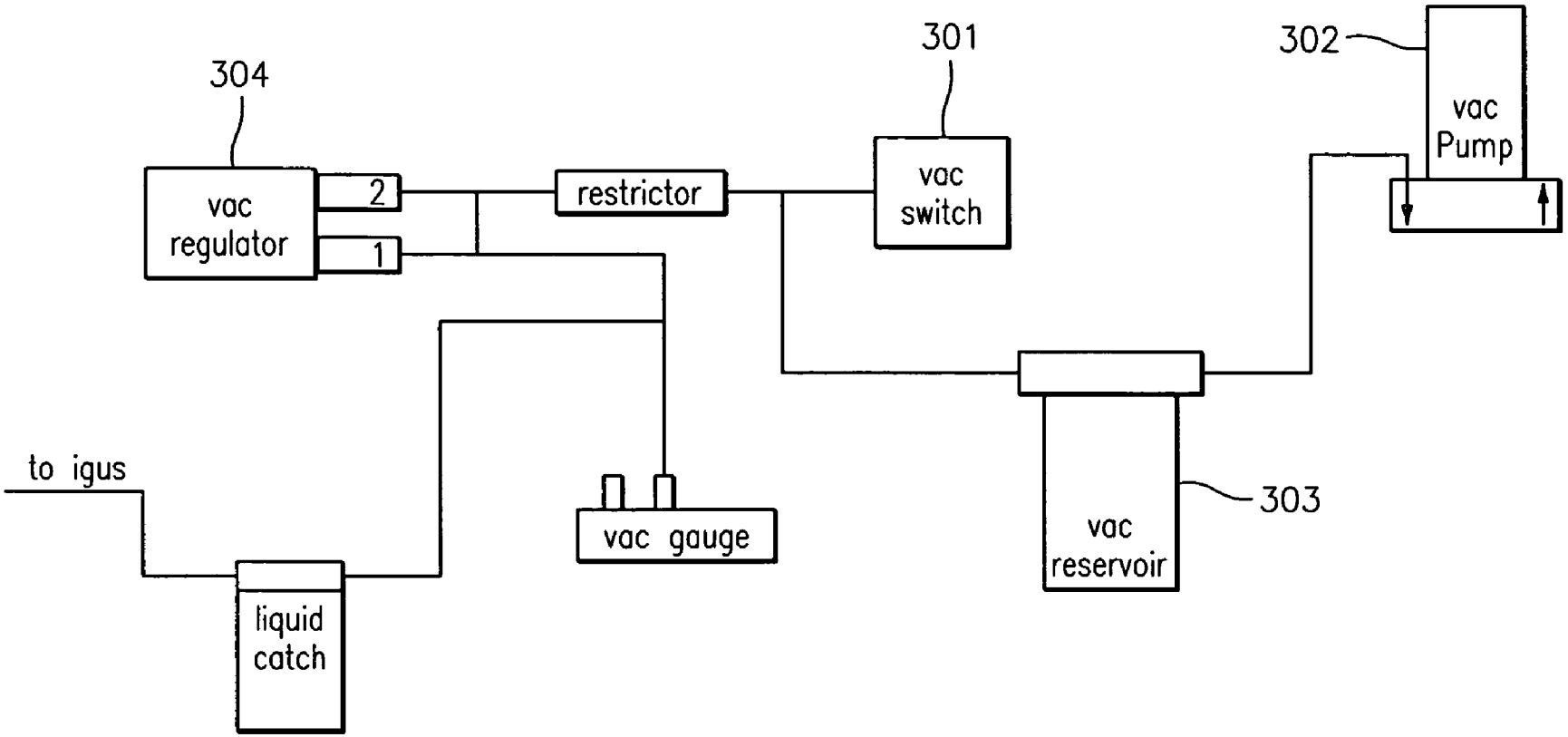
FIG. 28 (PRIOR ART)
FIG. 28 depicts a schematic of a prior art vacuum system.

A schematic of a typical prior art vacuum assembly is depicted in FIG. 28. The primary vacuum switch 301, which is typically an electromechanical switch, controls when the vacuum pump 302 turns on and off based on the vacuum level in the vacuum reservoir 303. This is a very coarse level of control, and a vacuum range of about 5 inches of water is typical. The primary vacuum level is reduced through a commercially available mechanical regulator 304 to the secondary vacuum level. The resultant nominal vacuum level is considerably less than the primary. Also, the range of the secondary vacuum level is controlled to less than 1% of the range of the primary vacuum level.

A problem of these vacuum assemblies is that the mechanical components of the vacuum regulator can wear out over time, causing a drift in the nominal value of the secondary vacuum level. To compensate for this drift, a user needs to manually reset the vacuum regulator. In the alternative, an automated vacuum regulator which has an electromechanical positioning system may be used to enable essentially the same actions as the manual operation.

Figure 27:
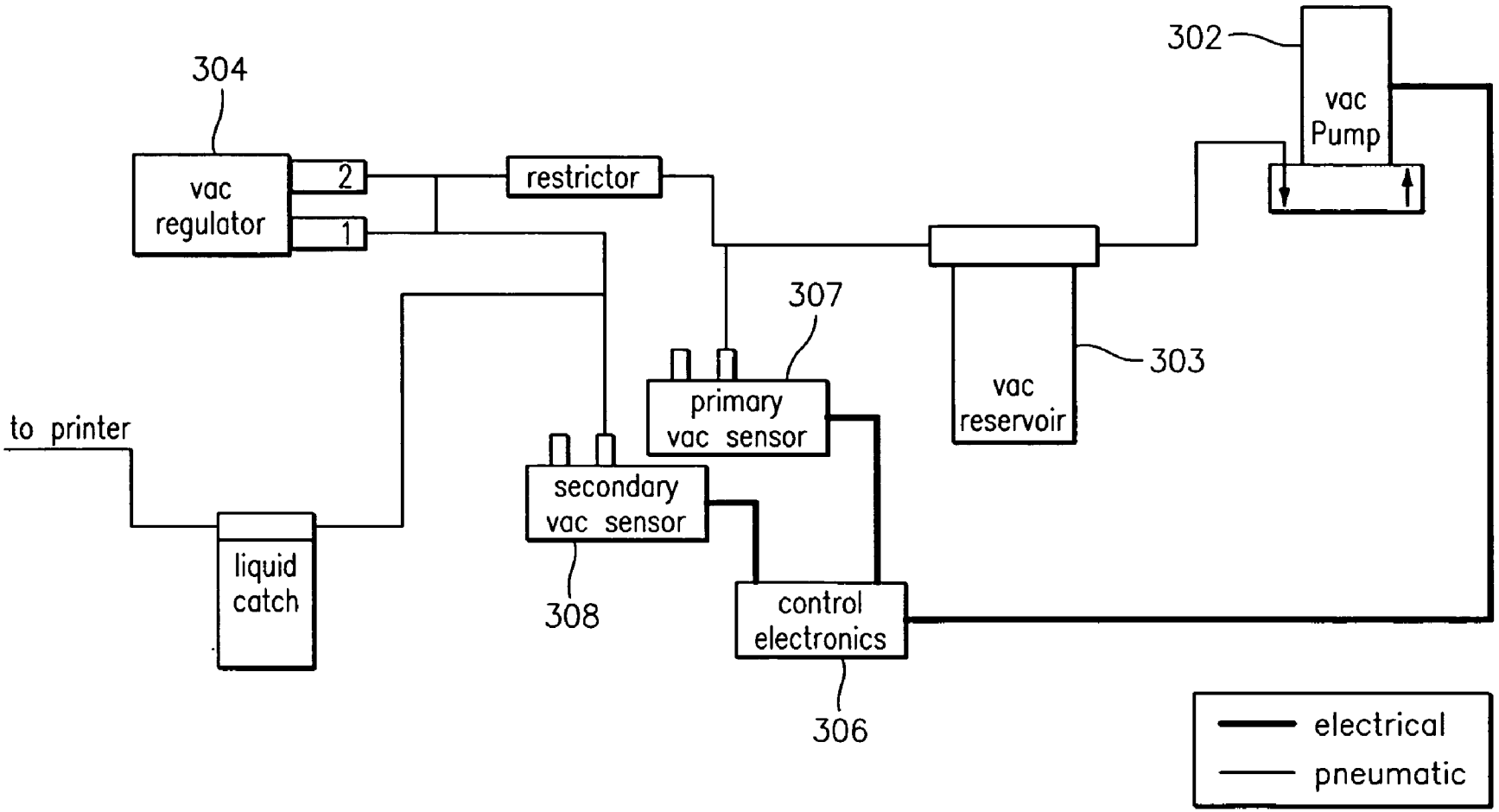
FIG. 27 depicts a schematic of a vacuum system in accordance with the present invention.

It is known that a gross variation in the primary vacuum level results in a much reduced variation in the secondary vacuum pressure level. Thus, the present invention relates to an improved system that controls the secondary vacuum level indirectly by controlling the primary vacuum level. As seen in FIG. 27, the present invention uses control electronics 306 to monitor a primary vacuum sensor 307, a secondary vacuum sensor 308, and to control the vacuum pump 302. The control electronics 306 uses solid state control electronics instead of the electromechanical vacuum switch of the prior art, and it is this control which enable the automatic compensation of wear out mechanisms without the addition of mechanical components.

Figure 29:
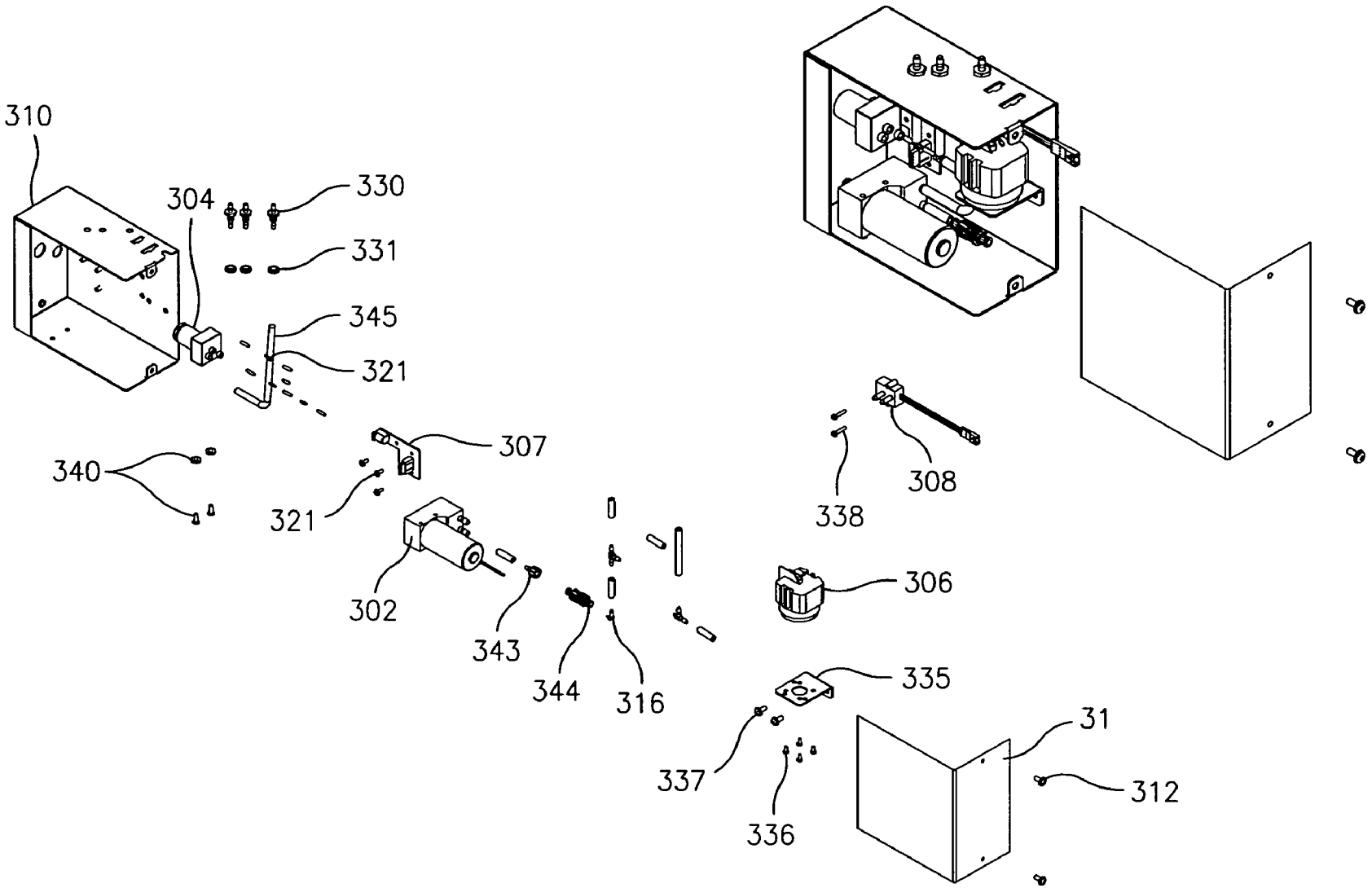
FIG. 29 depicts an exploded view of various components of the vacuum assembly in accordance with the present invention.
Figure 30:
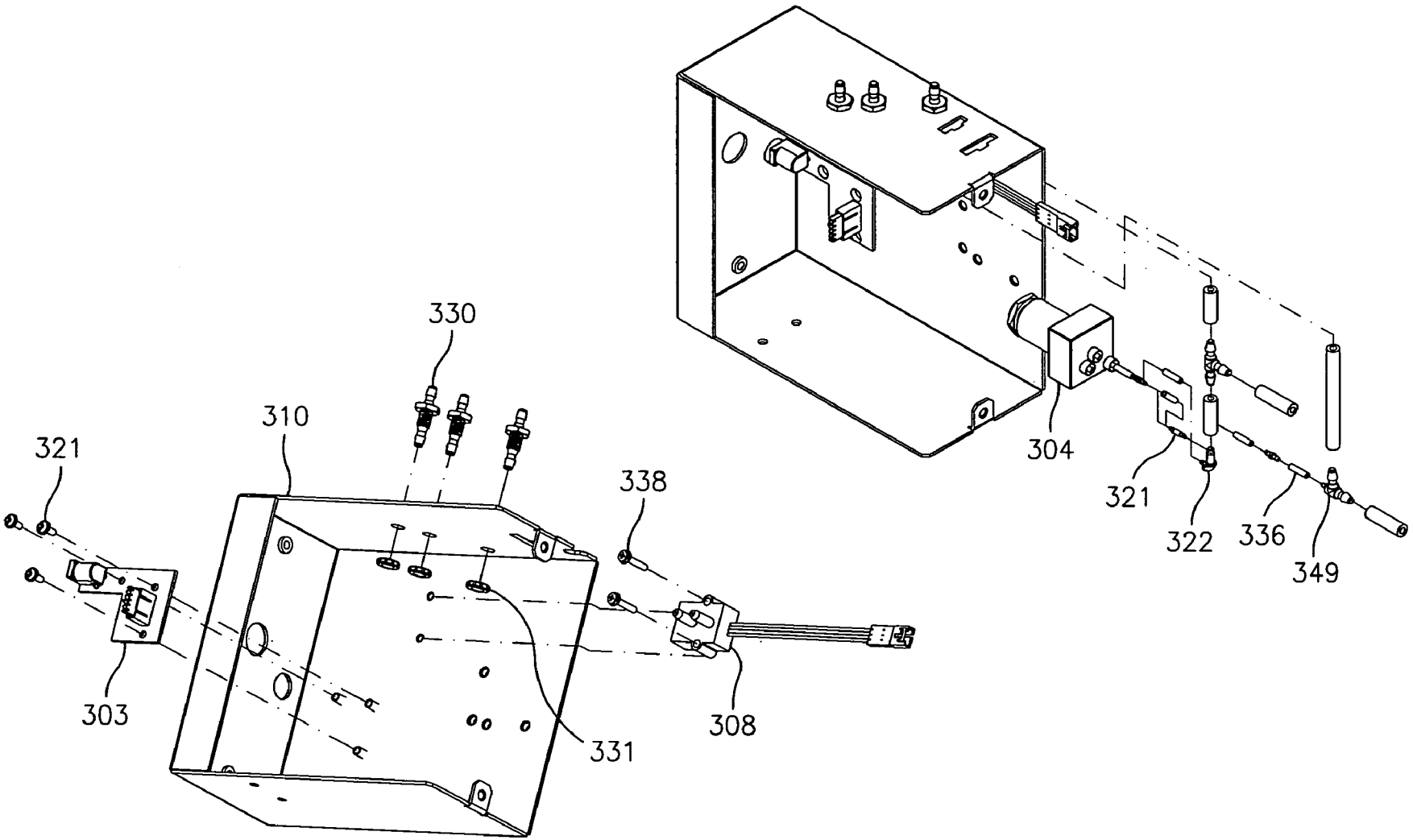
FIG. 30 depicts a different view of components of the vacuum assembly in accordance with the present invention.
Figure 31:
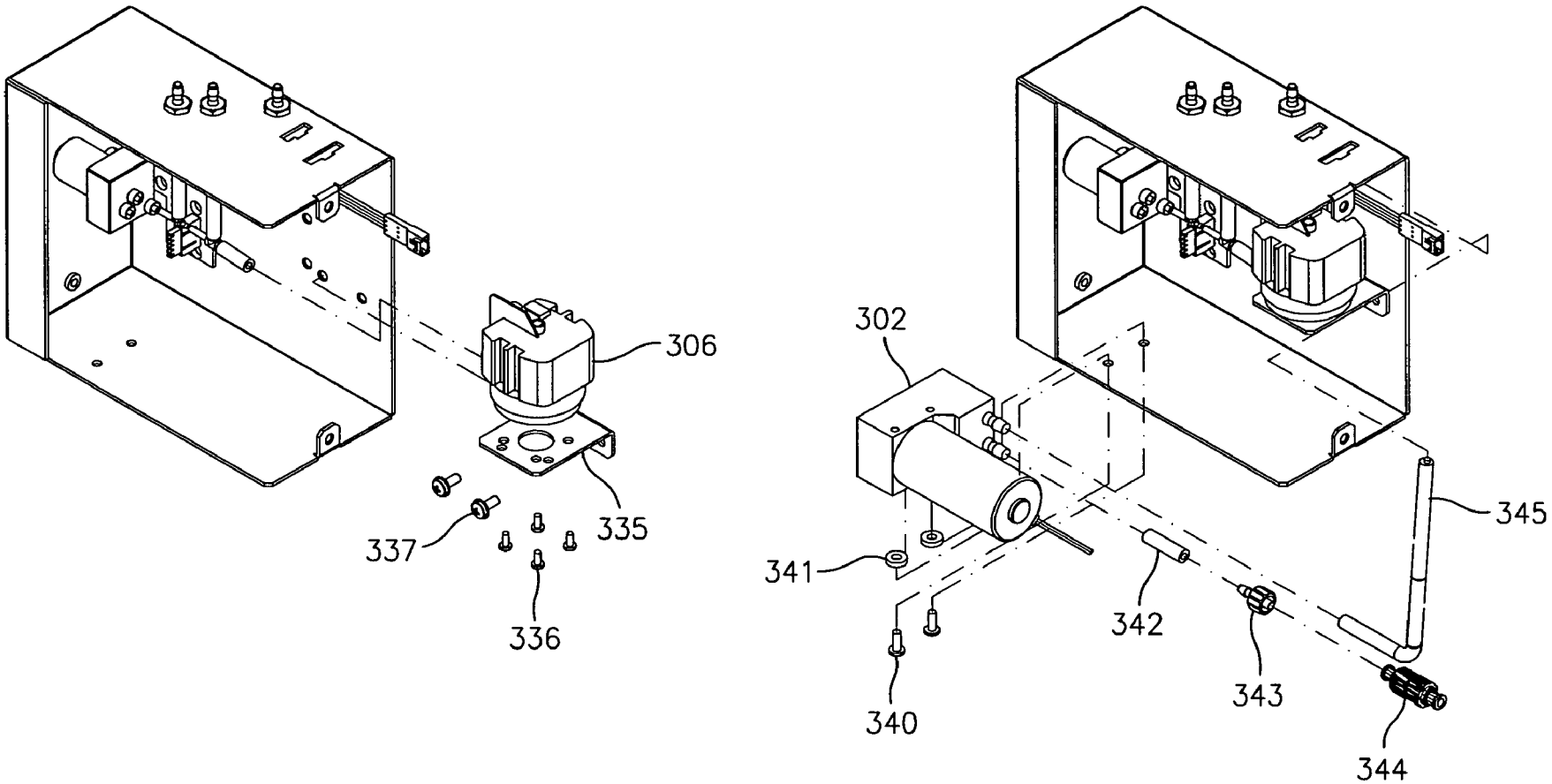
FIG. 31 depicts another view of components of the vacuum assembly in accordance with the present invention.

FIGS. 29-31 describe features of the vacuum system of the invention. As seen in FIG. 31, enclosure 310 houses various components of the vacuum system of the invention and is secured to cover 311 using fastening means 312. The enclosure 310 contains a diaphragm pump 302 that is secured into place in the bottom of the enclosure 310 using screws 340 and rubber washers 341. A first outlet of pump 302 is coupled to a tube 342 that is connected to a lock 343 and a check valve 344. A second outlet of pump 302 is connected to a tube 345 which is in turn connected to the vacuum reservoir 303.

The primary vacuum sensor 307 is secured to the enclosure 310 with suitable fastening means 321. The secondary vacuum sensor 308 is also secured to the enclosure 310 using suitable fastening means 338.

The vacuum regulator 304 is connected to an elbow reducer 322 and through a fitting 355 to the primary vacuum sensor 307. The vacuum regulator is also connected via an orifice fitting 356 to the secondary vacuum sensor 308.

Connectors 330 are mounted to the enclosure 310 and connect the vacuum assembly to the inkjet printheads 200. Control electronics 306, which typically comprise solid state control electronics are mounted on bracket 335 and secured in place with securing means 336. The bracket 335 is mounted to a side of the enclosure 310 and secured with securing means 337.

In another embodiment, the present invention is also directed to an improved method of minimizing print media waste in an inkjet printer assembly that uses a multi-pass print mode.

Previous methods to minimize print media waste are described in U.S. Pat. No. 6,848,765 to Cleveland and U.S. Pat. No. 6,457,806 to Hickman, the subject matter of each of which is herein incorporated by reference in its entirety.

Inkjet print heads generally comprises a large number of closely spaced jets (i.e, 96 jets) for depositing fluid on a surface of a print media. The number of jets may vary depending on the desired print density and by manufacture. In general, in a multi-pass print mode, a print image is assembled by splitting each printhead into a plurality of sections and passing the printhead over the print media multiple times. During each pass, a different section of the printhead prints a portion of the image on the print media. For example, in a four-pass mode, each printhead is split into four sections and for each of the four passes, one of the four sections prints a portion of the image on the print media. Thus, the print media is printed on four different times to assemble the dot density needed in the print image. In addition, each time the printhead passes over the print media, the print media is advanced ¼ of the distance of the printhead. Each of the four passes may provide a print density of 75 dots per inch (dpi) to obtain a desired print density of 300 dpi at the end of the four passes.

The print media can be advanced through the printer assembly in various ways, but is typically advanced using pinch rollers. However, there is typically a length of unused media remaining once the printing is completed, and it would be desirable to provide an improved means of minimizing this unused portion of the media to reduce waste. The present invention solves this problem by providing a method in which the print media is essentially not advanced during the final passes of the printheads over the print media or may be advanced in substantially pixel-sized increments. Instead, control means (i.e., software) are used to print a different percentage of the jets of the printhead during each of the last few (i.e., three) passes.

For example, in one embodiment the method includes the steps of:

a) advancing a print media through the inkjet printer assembly in a media advance direction;

b) providing a reciprocating carriage assembly that is capable of traversing the width of the print media in a direction perpendicular to the media advance direction, wherein the reciprocating carriage assembly comprises a plurality of inkjet printheads that are capable of depositing fluid in a desired pattern on the print media, c) performing multiple passes of the carriage assembly over the print media to deposit fluid in the desired pattern and print density;

wherein a desired print density is obtained by splitting the plurality of inkjet print heads into a plurality sections and performing multiples passes of the carriage assembly over the print media and depositing fluid from one of the plurality of sections of the inkjet printheads during each pass of the carriage assembly to obtain a desired print density on the print media;

d) sensing when a trailing edge of the print media is approaching a predetermined location in a print zone in the printer assembly;

e) substantially decreasing advancement of the print media through the printer assembly; and f) performing three passes of the carriage assembly over the print media while the print media is substantially stationary in the print zone of the printer assembly, wherein:

i) in a first pass, about 75% of the jets in the inkjet printhead deposit fluid on the print media;

ii) in a second pass, about 50% of the jets in the inkjet printhead deposit fluid on the print media; and iii) in a third pass, about 25% of the jets in the inkjet printhead deposit fluid on the print media, whereby print media waste on the trailing edge of the print media is minimized.

In addition, while the above example uses a four-pass print mode, the invention is not limited to a four-pass print mode. For example if a different number of passes is used, the final passes of the carriage assembly over the print media and the percentage of jets used in each pass may be adjusted. What is important though is that the advancement of the print media is essentially halted to perform the final few passes of the carriage assembly and the number of jets used in the final few passes is adjusted to achieve the desired print density.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall there between.

What is claimed is:

1. An ink jet printer apparatus comprising:

a platen assembly for supporting a print media within a print zone, wherein the platen assembly is capable of holding the print media in place during printing;

a media drive for guiding the print media across the platen and through the print zone, wherein the media drive is coupled to and cooperates with the platen assembly;

a rail assembly spaced apart from the platen assembly, said rail assembly supporting a scanning carriage assembly that is capable of traversing the width of the print media, said scanning carriage supporting at least one ink jet applicator assembly proximate to the print media; and at least one table assembly coupled to the platen assembly for supporting the print media as it is guided through the printer apparatus, wherein the at least one table assembly comprises a plurality of leaves.

2. The ink jet printer apparatus according to claim 1, wherein the platen assembly comprises:

a) an upper platen portion coupled to a lower platen portion, wherein the upper platen portion has a series of hole therein; and b) means for creating a vacuum to apply a suction force to the print media positioned on the upper platen portion;

whereby the suction force holds the print media against the upper platen portion during printing.

3. The ink jet printer apparatus according to claim 2, wherein the platen assembly comprises at least one roller shaft and the at least one table assembly is fixably attached to the platen assembly at the at least one roller shaft such that a top surface of the table is substantially level with the upper platen portion, whereby the at least one table assembly provides a stable and flush surface for printing.

4. The ink jet printer apparatus according to claim 3, wherein the at least one table assembly comprises:

a first leaf;

a second leaf slidably attached to the first leaf, wherein the second leaf is capable of sliding relative to the first leaf to extend the length of the table assembly in a first direction;

at least one leg positioned proximate to a first end of the first leaf adjacent to the second leaf;

wherein the table assembly is fixably attached to the platen proximate to a point adjacent to a second end of the first leaf.

5. The inkjet printer apparatus according to claim 4, wherein the at least one table assembly comprises two table assemblies, whereby a table assembly is provided on an input side of the printer apparatus and on an output side of the printer apparatus.

6. The ink jet printer apparatus according to claim 4, wherein the at least one leg is pivotally mounted, whereby the at least one leg is foldable flush against the leaves of the at least one table assembly for storage and the at least one leg can be unfolded to set up the table assembly for supporting the print media during printing.

7. The ink jet printer apparatus according to claim 4, wherein the second leaf comprises an extension portion that is capable of sliding out from an end of the leaf opposite the first leaf, whereby the length of the table assembly can be extended.

8. The ink jet printer apparatus according to claim 7, wherein the extension portion comprises a plurality of U-shaped wings.

9. The ink jet printer apparatus according to claim 4, wherein the table assembly is self-alignable at a point where it interfaces with the platen.

10. The ink jet printer apparatus according to claim 2, wherein the upper platen comprises extruded aluminum and horizontal surfaces of the upper platen remain unmachined.

11. The ink jet printer apparatus according to claim 2, wherein the upper platen is electrically grounded.

12. The ink jet printer apparatus according to claim 1, wherein the rail assembly comprises:

a plurality of pinch rollers; and a height controller for sensing the height of the media supported by the platen assembly.

13. The ink jet printer apparatus according to claim 12, wherein height controller comprises a lever assembly.

14. An ink jet printer apparatus comprising:

a platen assembly for supporting a print media within a print zone, wherein the platen assembly is capable of holding the print media in place during printing;

a media drive for guiding the print media across the platen and through the print zone, wherein the media drive is coupled to and cooperates with the platen assembly;

a rail assembly spaced apart from the platen assembly, said rail assembly supporting a scanning carriage assembly that is capable of traversing the width of the print media, said scanning carriage supporting at least one ink jet applicator assembly proximate to the print media, wherein said rail assembly comprises:

a plurality of pinch rollers, wherein each of the plurality of pinch rollers comprises a locking feature, said locking feature comprising a hook that is capable of being clipped into the extruded rail whereby the plurality of pinch rollers can be clipped into the extruded rail such that the pinch rollers do not touch the surface of the media being printed; and a height controller for sensing the height of the media supported by the platen assembly; and at least one table assembly coupled to the platen assembly for supporting the print media as it is guided through the printer apparatus.

15. The ink jet printer apparatus according to claim 14, wherein each of the plurality of pinch rollers is releasably engaged with a pinch roller bracket, whereby each of the plurality of pinch rollers is snapably replaceable.

* * * * *